US005723239A

United States Patent [19]

Itakura et al.

[11] Patent Number: 5,723,239

[45] Date of Patent: Mar. 3, 1998

[54] DESENSITIZING SOLUTION FOR OFFSET PRINTING

[75] Inventors: Ryosuke Itakura; Seishi Kasai; Hidefumi Sera; Eiichi Kato, all of Haibara-gun, Japan

[73] Assignee: Fuji Photo Film Co. Ltd., Kanagawa, Japan

[21] Appl. No.: 718,949

[22] Filed: Sep. 26, 1996

Related U.S. Application Data

[62] Division of Ser. No. 920,862, Jul. 28, 1992, Pat. No. 5,565,290.

[30] Foreign Application Priority Data

| | | | |
|---|---|---|---|
| Jul. 30, 1991 | [JP] | Japan | 3-190081 |
| Oct. 17, 1991 | [JP] | Japan | 3-269609 |
| Oct. 18, 1991 | [JP] | Japan | 3-269917 |
| Oct. 18, 1991 | [JP] | Japan | 3-269918 |
| Dec. 4, 1991 | [JP] | Japan | 3-320488 |

[51] Int. Cl.[6] ..... G03G 13/28

[52] U.S. Cl. ..... 430/49; 430/97; 106/2; 101/465; 101/466; 101/451

[58] Field of Search ..... 430/49, 97; 106/2; 101/465, 466, 451

[56] References Cited

U.S. PATENT DOCUMENTS

| | | | |
|---|---|---|---|
| 4,579,591 | 4/1986 | Suzuki et al. | 106/2 |
| 4,925,761 | 5/1990 | Kulisz, Sr. et al. | 430/97 |
| 5,006,169 | 4/1991 | Yoshida | 106/2 |
| 5,053,301 | 10/1991 | Kato et al. | 430/49 |

*Primary Examiner*—George F. Lesmes
*Assistant Examiner*—Steven H. VerSteeg
*Attorney, Agent, or Firm*—McAulay Fisher Nissen Goldberg & Kiel, LLP

[57] ABSTRACT

An amine compound-containing, but cyanogen-free, desensitizing solution for offset printing, characterized by containing phytic acid (inositol hexaphosphate) and/or a metal and/or ammonium salts of phytic acid, and at least one selected from the group consisting of amine compounds represented by the following general formulae (1) and (2); a carboxylic acid or carboxylate containing (3); an urea (5) and/or an urethane (6) containing (4); an amide compound represented by (8) and/or an imide compound (9), each containing an amino group (7); and a heterocyclic compound at least one nitrogen atom and having an inorganic/organic value of 0.1 to 4.0 inclusive.

(1)

(2)

(3)

(4)

(5)

(6)

(7)

(8)

(9)

5 Claims, No Drawings

DESENSITIZING SOLUTION FOR OFFSET PRINTING

This is a division of application Ser. No. 07/920,862, filed Jul. 28, 1992, now U.S. Pat. No. 5,565,290.

BACKGROUND OF THE INVENTION

The present invention relates to a solution for making lithographic plates such as electrophotographic offset or direct-image masters hydrophilic or, in other words, an etching or dampening solution, which is mainly composed of a metal oxide, a metal sulfide and a binder resin.

The present invention relates generally to a solution for making electrophotographic offset printing plates hydrophilic and, more specifically, to a cyanogen-free desensitizing solution for offset printing, which does not contain cyanide compounds at all.

An electrophotographic offset printing plate precursor (hereinafter called the printing master) includes a photosensitive layer in which photoconductive fine powders of material such as zinc oxide is dispersed in a resin binder, and is obtained by applying ordinary electrophotographic operations to this layer to form a lipophilic image.

Generally used for offset printing is a form plate made up of a non-image area likely to be wetted by water (the hydrophilic area) and a printing area unlikely to be wetted (the lipophilic area). However, the electrographic offset printing master is made up of a hydrophobic photoconductive layer so that when it is used by itself, normal printing cannot be made, because printing ink is deposited on the non-image area as well.

Therefore, prior to printing it is required to desensitize the non-image area of the printing master to make it hydrophilic. So far, cyanogen compound-containing treating solutions containing ferrocyanides and ferricyanides as the main component and cyanogen-free treating solutions containing an ammine-cobalt complex, phytic acid (inositol hexaphosphate) and its derivative and a guanidine derivative as the main component have been proposed as such desensitizing solutions.

However, these treating solutions are still less than satisfactory. That is, the former ferrocyanide and ferricyanide-containing treating solutions have some advantages of having strong desensitizing power, being capable of forming a firm, hydrophilic film and being high in the film forming rate, but have various problems in that ferrocyanide and ferricyanide ions are so unstable to heat and light that upon exposed to light, they are colored to form precipitates which makes the desensitizing power weak, and in the process of cyanogen analysis treated with strong acids, non-toxic cyanogen complexes are detected as free cyanogen, thus offering waste water disposal and pollution problems.

In view of these considerations, on the other hand, the cyanogen-free treating solutions containing the latter desensitizing agents as the main component have been proposed in the art. However, these treating solutions are still insufficient to obtain satisfactory lithographic masters. More specifically, the latter are slower in the film forming rate than the former, and so have the disadvantage that a hydrophilic film having a physical strength high enough for immediate printing cannot be formed only by passing a plating precursor once in the processor etching manner, giving rise to scumming or degradation of dot gradation.

So far, it has been known that phytic acid and its metal derivative form metal chelate compounds, and various desensitizing agents for offset masters have been proposed in the art. However, they are all slow in the film forming rate, so that any printable, hydrophilic film cannot be formed by a single processor treatment; that is, they have the disadvantage that there is scumming or degradation of dot gradation due to unsatisfactory separability.

In order to solve the problems mentioned above, investigation has been made as to the addition of various additives to the treating solutions based on phytic acid. Specifically, there are available treating solutions to which lower amines, alkanolamines and polyamines (see, for instance, Japanese Provisional Patent Publication Nos. 54-117201, 53-109701 and 1-25994). These solutions maintain good water retention in the initial stage of use, but gets worse in terms of etching and water retention, as they are continuously used. In addition, when they are used after long-term storage, the water retention drops, making scumming likely to occur.

Furthermore, there are available treating solutions to which cation polymers are added (see, for instance, Japanese Provisional Patent Publication No. 60-23099). Like the phytic acid solutions, these solutions degrade after continued use and long-term storage and gives rise to rust as well.

In view of energy saving, on the other hand, automatic printing machines of small size with built-in desensitizing systems have been particularly spread in recent years, and the plate-making with offset masters by electrophotography have been achieved within a more reduced time than ever before. For this reason, it is now required that the desensitizing time be reduced and the life of the desensitizing solution be increased. However, these are difficult to achieve by conventional treating solutions.

A primary object of this invention is to provide a desensitizing or dampening solution for offset printing plate precursors which poses no pollution problem, can be stably used after long-term storage and continued use, and can reduce the etching time or is excellent in the desensitizing capability.

SUMMARY OF THE INVENTION

According to this invention, the problems mentioned above can be solved by using the following treating solution for etching.

More specifically, the cyanogen-free desensitizing solution for offset printing is characterized by containing:

(a) phytic acid (inositol hexaphosphate) and/or a metal salt and/or an ammonium salt of phytic acid, and at least one selected from the group consisting of (b)–(f):

(b) secondary and tertiary amine compounds represented by the following general formula (1):

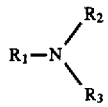

(1)

wherein $R_1$, and $R_2$ and $R_3$ have at least 9 carbon atoms in all, and $R_1$ denotes an aliphatic group having at least 6 carbon atoms and $R_2$ and $R_3$ each stand for a hydrogen atom and an aliphatic group or may optionally form together a cyclic structure, and/or a primary amine compound represented by the following general formula (2):

$$R_4\text{–}NH_2 \quad (2)$$

wherein $R_4$ denotes an aliphatic group having at least 6 carbon atoms, (c) a carboxylic acid (—COOH) and/or a carboxylate (—COOH—) containing at least an amino group represented by the following general formula (3):

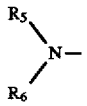

(3)

wherein $R_5$ and $R_6$ each denote a hydrogen atom and/or an organic residue or may combined with each other to form a cyclic structure, and having an inorganic/organic value lying in the range of 0.1 to 4.0 inclusive wherein, by definition, the term "inorganic/organic value" is a value representing the degree of the electrostatic (or polar) nature of an organic compound (for instance, see Yoshio Koda et al "Organic Conception Diagram", Sankyo Shuppan (May 10, 1985), (d) a urea compound represented by the following general formula (5) and/or a urethane compound represented by the following general formula (6), each containing at least an amino group represented by the following general formula (4) and having an inorganic/organic value lying in the range of 0.1 to 4.0 inclusive:

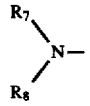

(4)

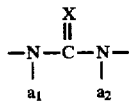

(5)

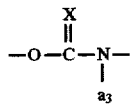

(6)

wherein $a_1$, $a_2$ and $a_3$ each stand for a hydrogen atom and/or an organic residue, $R_7$ and $R_8$ each denote a hydrogen atom and/or an organic residue or may optionally be combined with each other to form a cyclic structure, and X refers to an oxygen or sulfur atom.

(e) an amide compound represented by the following general formula (8) and/or an imide compound having the following general formula (9), each containing at least an amino group represented by the following general formula (7):

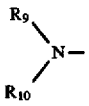

(7)

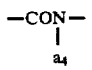

(8)

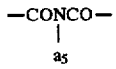

(9)

wherein $R_9$ and $R_{10}$ each stand for a hydrogen atom and/or an organic residue or may optionally be combined with each other to form a cyclic structure, and $a_4$ and $a_5$ each denote a hydrogen atom and/or an organic residue and/or a substituent such as a halogen atom or a cyano or nitro group, and (f) a heterocyclic compound containing at least one nitrogen atom and having an inorganic/organic value lying in the range of 0.1 to 4.0 inclusive, preferably a nitrogen-containing aromatic and/or aliphatic heterocyclic compound which may have a 3 to 10-membered substituent that may be condensed together.

DESCRIPTION OF THE PREFERRED EMBODIMENT

In the secondary or tertiary amines of this invention represented by Formulae (1) and (2), it is preferred that $R_1$ stands for a $C_{8-18}$ alkyl, cycloalkyl, alkenyl or aralkyl group which may have a subsitituent, for instance, an alkoxy (—$OR_1$), sulfide (—$SR_1$), amino

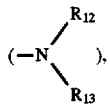

halogen, cyano, nitro or other group.

$R_2$ and $R_3$ each denote a hydrogen atom and a $C_{1-18}$ aliphatic group mentioned for $R_1$, or they may be aliphatic rings which can be combined with each other. $R_4$ denotes an aliphatic group having at least 8 carbon atoms, mentioned for $R_1$. $R_{12}$ and $R_{13}$ each denote a hydrogen atom and a $C_{1-18}$ aliphatic group mentioned for $R_1$, or they may be aliphatic rings which can be combined with each other.

More preferably, $R_1$ represents:

a $C_{8-18}$ alkyl group which may have a substituent (for instance, 2-ethylhexyl, octyl, decyl, dodecyl, tetradecyl, hexadecyl, octadecyl, 2-hydroxyoctyl, 2-hydroxyoctadecyl, 2,4-dihydroxyoctyl, 2-methoxyoctyl, 2-chlorooctyl, 2-bromooctyl, 2-cyanooctyl, etc.), a cycloalkyl group which Fay have a substituent (for instance, 2-ethylcyclohexyl, 2-methylcycloheptyl, 2,4-dimethylcyclohexyl, decalino, etc.), and, an alkenyl group which may have a substituent (for instance, 3-ethyl-hexenyl, 3-ethyl-hexenyl, 3,7-dimethyl-6-octenyl, 1-octenyl, 4-methyl-2-octenyl, etc.).

$R_2$ and $R_3$ each represent:

a hydrogen atom, a $C_{1-14}$ alkyl group which may have a substituent (for instance, methyl, ethyl, propyl, isopropyl, butyl, isobutyl, heptyl, hexyl, octyl, decyl, dodecyl, hexadecyl, octadecyl, 2-hydroxyethyl, 2-hydroxypropyl, 3-hydroxypropyl, 4-hydroxybutyl, 2-hydroxybutyl, 2-methoxyethyl, 2-butoxyethyl, 2-ethoxyethyl, 4-methoxybutyl, methylthioethyl, methylthiobutyl, 2-aminoethyl, N,N'-dimethylaminoethyl, piperidinoethyl, pyrrolidinoethyl, 2-chloroethyl, 2-chlorobutyl, 2-bromoethyl, 2-cyanoethyl, 4-cyanobutyl, etc.), an alkenyl group which may have a substituent (for instance, 2-methyl-1-propenyl, 2-butenyl, 2-pentenyl, 3-methyl-2-pentenyl, 1-pentenyl, 1-hexenyl, 2-hexenyl, 4-methyl-2-hexenyl, vinyl, 2-propenyl, 3-butenyl, etc.), an aralkyl group which may have a subsitituent (for instance, benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl, cyanobenzyl, nitrobenzyl, etc.), and a cycloalkyl group which may have a substituent (for instance, cyclopropyl, cyclobutyl, cyclopentyl, cyclohexyl, cycloheptyl, 4-methylcyclohexyl, 4-chlorocyclohexyl, 4-methoxycyclohexyl, 4-cyanocyclohexyl, etc.)

Optionally, $R_2$ and $R_3$ may be combined with each other to form an ethyleneimine, pyrrolidine or piperidine ring.

$R_4$ represents:

a $C_{8-18}$ alkyl group which may have a substituent (for instance, 2-ethylhexyl, octyl, decyl, dodecyl, tetradecyl, hexadecyl, octadecyl, 2-hydroxyoctyl, 2-hydroxyoctadecyl, 2,4-dihydroxyoctyl, 2-methoxyoctyl, 2-chlorooctyl, 2-bromooctyl, 2-cyanooctyl, etc. ), a cycloalkyl group which may have a substituent (for instance, 2-ethylcyclohexyl, 2-methylcylcoheptyl, 2,4-dimethylcyclohexyl, decalino, etc. ), and an alkenyl group which may have a substituent (for instance, 3-ethyl-2-hexenyl, 3-ethyl-3-hexenyl, 3,7-dimethyl-6-octenyl, 1-octenyl, 4-methyl-2-octenyl, etc.).

Specific, but not exclusive, examples of the compounds represented by Formulae (1) and (2) are set out below.

Throughout the following compounds 1–99, "α2EH" refers to $$-CH_2\underset{\underset{CH_2CH_3}{|}}{CH}(CH_2)_3CH_3 \text{ (2-ethylhexyl group)},$$

(2-ethylhexyl group), "nBu" to $-nC_4H_9$ (butyl group), "nHx" to $-nC_6H_{13}$ (hexyl group), "nOct" to $-nC_8H_{17}$ (octyl group), "nDode" to $-nC_{12}H_{25}$ (dodecyl group) and "nOctdec" to $-nC_{18}H_{37}$ (octadecyl group).

$[(CH_3)_2CH]_2N\text{-}2EH$ 1.

$(CH_3CH_2)_2N\text{-}2EH$ 2.

$(CH_3)_2N\text{-}2EH$ 3.

$(CH_3CH_2CH_2)_2N\text{-}2EH$ 4.

$(CH_3CH_2CH_2CH_2)_2N\text{-}2EH$ 5.

$(CH_3\overset{\overset{CH_3}{|}}{C}HCH_2)_2N\text{-}2EH$ 6.

$(CH_3)_2CH-\underset{\underset{CH_3}{|}}{N}\text{-}2EH$ 7.

$(CH_3)_2CH-\underset{\underset{CH_2CH_3}{|}}{N}\text{-}2EH$ 8.

$(CH_3)_2CH-\underset{\underset{CH_2CH_2CH_2CH_3}{|}}{N}\text{-}2EH$ 9.

$CH_3CH_2-\underset{\underset{CH_3}{|}}{N}\text{-}2EH$ 10.

$CH_3CH_2-\underset{\underset{CH_2CH_2CH_3}{|}}{N}\text{-}2EH$ 11.

$CH_3CH_2-\underset{\underset{CH_2CH_2CH_2CH_3}{|}}{N}\text{-}2EH$ 12.

$CH_3CH_2-\underset{\underset{nHx}{|}}{N}\text{-}2EH$ 13.

$CH_3-\underset{\underset{CH_2CH_2CH_2CH_3}{|}}{N}\text{-}2EH$ 14.

-continued $CH_3-\underset{\underset{nHx}{|}}{N}\text{-}2EH$ 15.

$CH_3-\underset{\underset{2EH}{|}}{N}\text{-}2EH$ 16.

$(nHx)_2N\text{-}2EH$ 17.

$(2EH)_3N$ 18.

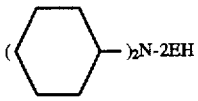
19.

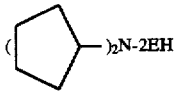
20.

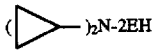
21.

$(ClCH_2CH_2)_2N\text{-}2EH$ 22.

$(CH_3OCH_2CH_2)_2N\text{-}2EH$ 23.

$(CH_3CH_2OCH_2CH_2)_2N\text{-}2EH$ 24.

$CH_3OCH_2CH_2-\underset{\underset{CH_2CH_3}{|}}{N}\text{-}2EH$ 25.

$CH_3CH_2OCH_2CH_2\underset{\underset{CH_3}{|}}{N}\text{-}2EH$ 26.

$(CH_3SCH_2CH_2)_2N\text{-}2EH$ 27.

$(NCCH_2CH_2)_2N\text{-}2EH$ 28.

$(HOCH_2CH_2)_2N\text{-}2EH$ 29.

$HOCH_2CH_2-\underset{\underset{CH_3}{|}}{N}\text{-}2EH$ 30.

$HOCH_2CH_2-\underset{\underset{CH_2CH_3}{|}}{N}\text{-}2EH$ 31.

$HOCH_2CH_2-\underset{\underset{CH_2CH_2CH_2CH_3}{|}}{N}\text{-}2EH$ 32.

$HOCH_2CH_2-\underset{\underset{nHx}{|}}{N}\text{-}2EH$ 33.

$(CH_3\overset{\overset{OH}{|}}{C}HCH_2)_2N\text{-}2EH$ 34.

$CH_3\overset{\overset{OH}{|}}{C}HCH_2-\underset{\underset{CH_2CH_3}{|}}{N}\text{-}2EH$ 35.

$CH_3\overset{\overset{OH}{|}}{C}HCH_2-\underset{\underset{CH_2CH_2CH_2CH_3}{|}}{N}\text{-}2EH$ 36.

$CH_3\overset{\overset{OH}{|}}{C}HCH_2-\underset{\underset{CH_2CH_2OH}{|}}{N}\text{-}2EH$ 37.

$CH_3\overset{\overset{OH}{|}}{C}HCH_2-\underset{\underset{CH_2CH_2OCH_3}{|}}{N}\text{-}2EH$ 38.

-continued

39. $(HOCH_2CH_2CH_2)_2N-2EH$ (with $CH_3$ on the 2-position)

40. $(HOCH_2CH_2CH_2CH_2)_2N-2EH$

41. $[(CH_3)_2CH]_2N-nOct$

42. $(CH_3CH_2)_2N-nOct$

43. $(CH_3)_2N-nOct$

44. $[(CH_3)_2CH]_2N-nDode$

45. $(CH_3CH_2)_2N-nDode$

46. $(CH_3)_2N-nOctdec$

47. 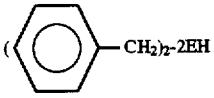

48. 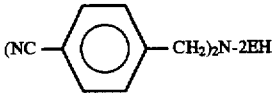

49. 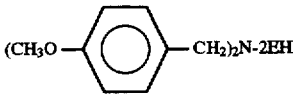

50. $(H_2NCH_2CH_2)_2N-2EH$

51. $[(CH_3)_2NCH_2CH_2]_2N-2EH$

52. 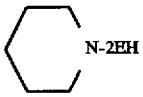

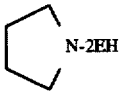

53. $[H_2NCH_2CH_2(NHCH_2CH_2)_2]_2N-2EH$

54. $[(CH_3)_2NCH_2CH_2(NCH_2CH_2)_2]_2N-2EH$ ($CH_3$ on the 2-position)

55. $[HOCH_2CH_2(O-CH_2CH_2)_2]_2N-2EH$

56. $[CH_3CH(OH)CH_2]_2N-nOct$

57. $[CH_3CH(OH)CH_2]_2N-nDode$

58. $(HOCH_2CH_2)_2N-nOct$

59. $(HOCH_2CH_2)_2N-nDode$

60. $(HOCH_2CH_2)_2N-nOctdec$

61. $(CH_3)_2CH-NH-2EH$

62. $CH_3CH_2-NH-2EH$

63. $CH_3-NH-2EH$

64. $CH_3CH_2CH_2-NH-2EH$

65. $CH_3CH_2CH_2CH_2-NH-2EH$ 66. nHx-NH-2EH

67. 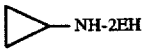

68. 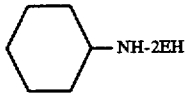

69. $HOCH_2CH_2NH-2EH$

70. $CH_3CH(OH)CH_2-NH-2EH$

71. $CH_3OCH_2CH_2-NH-2EH$

72. $CH_3SCH_2CH_2-NH-2EH$

73. 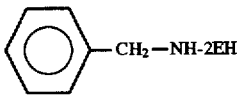

74.

-continued

75. 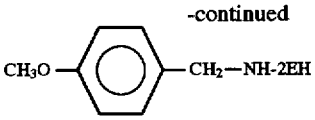

76. $H_2NCH_2CH_2NH-2EH$

77. 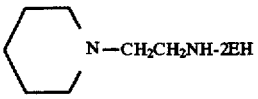

78. $H_2NCH_2CH_2(NCH_2CH_2)_2NH-2EH$

79. $HOCH_2CH_2(OCH_2CH_2)_2-NH-2EH$

80. $ClCH_2CH_2-NH-2EH$

81. $(CH_3)_2CH-NH-nOct$

82. $CH_3CH_2-NH-nOct$

83. $(CH_3)_2CH-NH-nDode$

84. $CH_3CH_2-NH-nDode$

85. $CH_3-NH-nDode$

86. $CH_3CH_2-NH-nOctdec$

87. $CH_3-NH-nOctdec$

88. 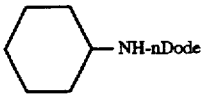

89. $HOCH_2CH_2-NH-nDode$

90. $CH_3CH(OH)CH_2-NH-nDode$

91. $HOCH_2CH_2-NH-nOctDec$

92. $nC_{10}H_{21}-NH_2$

93. $nDode-NH_2$

94. $nOctDec-NH_2$

95. $Cl(CH_2)_{10}-NH_2$

96. $HO(CH_2)_{10}-NH_2$

97. $(nOct)_2NH$

98. $(nDode)_2NH$

99. $(2EH)_2NH$

Referring to the carboxylic acid (—COOH) and/or carboxylate (—COOH—) compounds containing an amino group represented by Formula (3) and having an inorganic/organic value lying in the range of 0.1 to 4.0 inclusive, it is preferred that $R_5$ and $R_6$ each denote a hydrogen atom and/or a $C_{1-22}$ alkyl, cycloalkyl, alkenyl, aralkyl or aryl group which may have a substituent, or they may be combined with each other to form a cyclic structure. The above-mentioned substituent, for instance, may be hydroxide, alkoxy, sulfide, amino, cyano and nitro groups and halogen atoms.

More preferably, $R_5$ and $R_6$ each denote:

$C_{1-18}$ alkyl group which may have a substituent which may have a substituent (for instance, methyl, ethyl, propyl, isopropyl, butyl, isobutyl, heptyl, hexyl, 2-ethylhexyl octyl, decyl, dodecyl, hexadecyl octadecyl, 2-hydroxyethyl, 2-hydroxypropyl, 3-hydroxypropyl, 4-hydroxybutyl, 2-hydroxybutyl, 2-methoxyethyl, 2-butoxyethyl, 2-ethoxyethyl, 4-methoxybutyl, methylthioethyl, methylthiobutyl, 2-aminoethyl, N,N'-dimethylaminoethyl, piperidinoethyl, pyrrolidinoethyl, 2-chloroethyl, 2-chlorobutyl, 2-bromoethyl, 2-cyanoethyl, 4-cyanobutyl, etc.), an alkenyl group which may have a substituent (for instance, 2-methyl-1-propenyl, 2-butenyl, 2-pentenyl, 3-methyl-2-pentenyl, 1-pentenyl, 1-hexenyl, 2-hexenyl, 4-methyl-2-hexenyl, vinyl, 2-propenyl, 3-butenyl, etc.), an aralkyl group which may have a subsitituent (for instance, benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl, cyanobenzyl, nitrobenzyl, etc.), a cycloalkyl group which may have a substituent (for instance, cyclopropyl, cyclobutyl, cyclopentyl, cyclohexyl, cycloheptyl, 4-methylcyclohexyl, 4-chlorocyclohexyl, 4-methoxycyclohexyl, 4-cyanocyclohexyl, etc.), and an aryl group which may have a substituent (for instance, phenyl, tolyl, ethylphenyl, propylphenyl, chlorophenyl, fluorophenyl, bromophenyl, chloro-methyl-phenyl, dichlorophenyl, methoxyphenyl, cyanophenyl, acetamidephenyl, acetylphenyl, butoxyphenyl, etc.).

Optionally, $R_5$ and $R_6$ may be combined with each other to form a ring such as an aziridine, pyrrolidine, piperidine, morpholine or other ring.

It is noted that these compounds contain per molecule preferably 1 to 10, more preferably 1 to 6 amino groups, and per molecule preferably 1 to 10, more preferably 1 to 6 carboxyl groups and/or ester bonds.

Specific, but not exclusive, examples of the carboxylic acid or carboxylate compounds containing an amino group represented by Formula (3) are enumerated below.

$(CH_3)_2NCH_2CH_2COO$-2EH 101.
$(CH_3CH_2)_2NCH_2CH_2COO$-2EH 102.
$(CH_3CH_2CH_2)_2NCH_2CH_2COO$-2EH 103.
$[(CH_3)_2CH]_2NCH_2CH_2COO$-2EH 104.
$(nBu)_2NCH_2CH_2COO$-2EH 105.
$(nHx)_2NCH_2CH_2COO$-nBu 106.
$(2EH)_2NCH_2CH_2COO-CH_2CH_3$ 107.
$(HOCH_2CH_2)_2NCH_2CH_2COO$-2EH 108.

$(CH_3\overset{OH}{\overset{|}{C}}HCH_2)_2NCH_2CH_2COO$-2EH 109.

$HOCH_2CH_2\underset{\underset{CH_2CH_3}{|}}{N}CH_2CH_2COO$-2EH 110.

$HOCH_2CH_2\underset{\underset{nBu}{|}}{N}CH_2CH_2COO$-2EH 111.

$[HO(CH_2)_4]_2NCH_2CH_2COO$-2-EH 112.
$(CH_3OCH_2CH_2)_2NCH_2CH_2COO$-2EH 113.
$(CH_3CH_2OCH_2CH_2)_2NCH_2CH_2COO$-2EH 114.

$CH_3CH_2OCH_2CH_2\underset{\underset{nBu}{|}}{N}CH_2CH_2COO$-2EH 115.

$(ClCH_2CH_2)_2NCH_2CH_2COO$-2EH 116.
$(BrCH_2CH_2)_2NCH_2CH_2COO$-2EH 117.
$(NCCH_2CH_2)_2NCH_2CH_2COO$-2EH 118.
$(O_2NCH_2CH_2)_2NCH_2CH_2COO$-2EH 119.
$(CH_2=CHCH_2)_2NCH_2CH_2COO$-2EH 120.

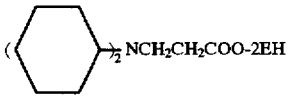
121.

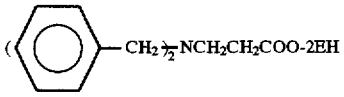
122.

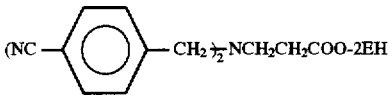
123.

-continued

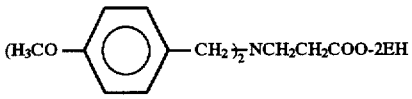
124.

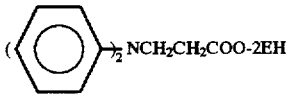
125.

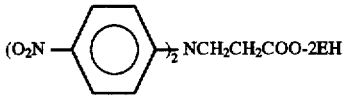
126.

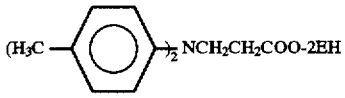
127.

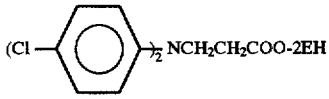
128.

$CH_3NHCH_2CH_2COO$-2EH 129.
$CH_3CH_2NHCH_2CH_2COO$-2EH 130.
$CH_3CH_2CH_2NHCH_2CH_2COO$-2EH 131.
$(CH_3)_2CHNHCH_2CH_2COO$-2EH 132.
$nBuNHCH_2CH_2COO$-2EH 133.
$nHxNHCH_2CH_2COO$-2EH 134.

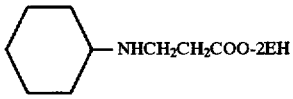
135.

$HOCH_2CH_2NHCH_2CH_2COO$-2EH 136.

$CH_3\overset{OH}{\overset{|}{C}}HCH_2NHCH_2CH_2COO$-2EH 137.

$CH_3OCH_2CH_2NHCH_2CH_2COO$-2EH 138.
$BrCH_2CH_2NHCH_2CH_2COO$-2EH 139.
$NCCH_2CH_2NHCH_2CH_2COO$-2EH 140.
2EH-$NHCH_2CH_2COO$-2EH 141.
$(CH_3CH_2)_2NCH_2CH_2COO$-nDode 142.
$(CH_3CH_2)_2NCH_2CH_2COO$-nOctdec 143.
$(CH_3CH_2)_2NCH_2CH_2COO$-nHx 144.

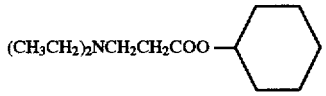
145.

$(CH_3CH_2)_2NCH_2CH_2COO$-nBu 146.

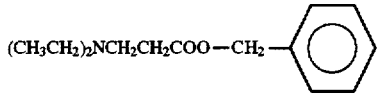
147.

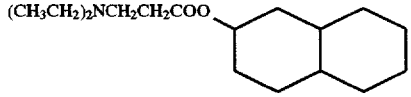
148.

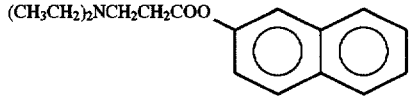
149.

-continued

150. 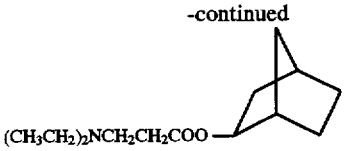

151. 2EH-NHCH$_2$CH$_2$COOCH$_3$ 152. 2EH-NHCH$_2$CH$_2$COOCH$_2$CH$_3$ 153. 2EH-NHCH$_2$CH$_2$COO-nBu 154. 2EH-NHCH$_2$CH$_2$COO-nHx

155. 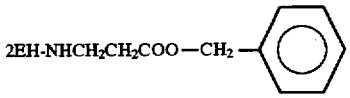

156. 2EH-NHCH$_2$CH$_2$COO—CH$_2$CH=CH$_2$

157. 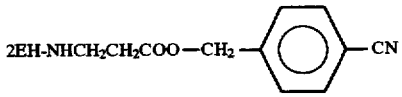

158. 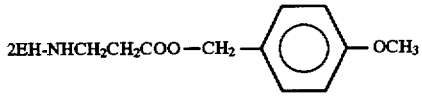

159. 2EH-NHCH$_2$CH$_2$COOCH$_2$CH$_2$N(CH$_3$)$_2$ 160. 2EH-NHCH$_2$CH$_2$COO(CH$_2$)$_4$Br 161. 2EH-NHCH$_2$CH$_2$COO(CH$_2$)$_4$OH 162. (CH$_3$CH$_2$)$_2$N(CH$_2$)$_4$COO-2EH 163. (CH$_3$CH$_2$)$_2$N(CH$_2$)$_6$COO-2EH 164. (CH$_3$CH$_2$)$_2$NCH$_2$COO-2EH

165. 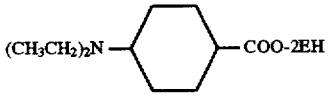

166. 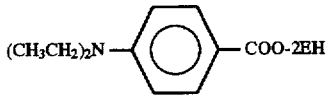

167. (CH$_3$CH$_2$)$_2$N(CH$_3$CH$_2$O)$_2$COO-2EH 168. (CH$_3$CH$_2$)$_2$N(CH$_3$CH$_2$O)$_4$COO-2EH

169. R—CH$_2$CH$_2$—R

170. R—(CH$_2$)$_4$—R

171. R—(CH$_2$)$_6$—R

172. 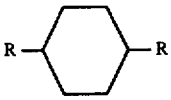

173. 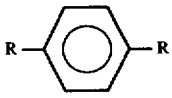

174. 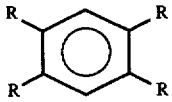

175. 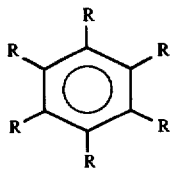

-continued

176. 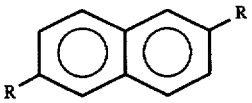

177. 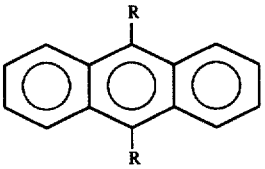

(The above R represents 2EH-NHCH$_2$CH$_2$COO—.)

178. R'—CH$_2$CH$_2$—R'

179. R'—(CH$_2$)$_4$—R'

180. R'—(CH$_2$)$_6$—R'

181. 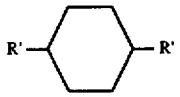

182. 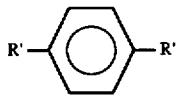

183. 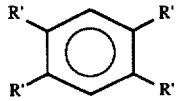

184. 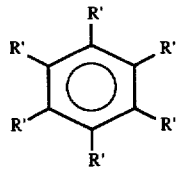

(The above R' represents —NHCH$_2$CH$_2$COO-2EH.)

185. 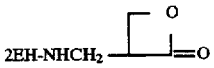

186. 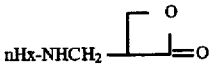

187. 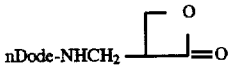

188. 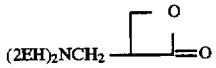

189. 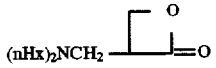

190. 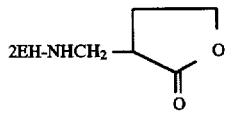

191. 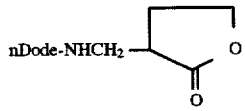

-continued

192. 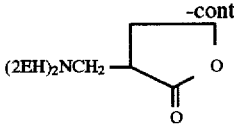

193. 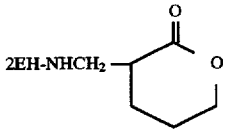

194. 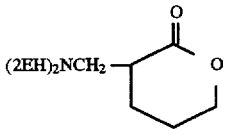

195. 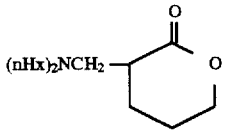

196. $2EH\text{-}NHCH_2CH_2COOH$

197. $nHx\text{-}NHCH_2CH_2COOH$

198. $nDode\text{-}CH_2CH_2COOH$

199. $nOctdec\text{-}NHCH_2CH_2COOH$

200. 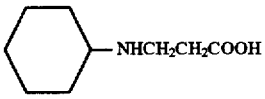

201. $(2EH)_2NCH_2CH_2COOH$

202. $(nHx)_2NCH_2CH_2COOH$

203. $(nDode)_2NCH_2CH_2COOH$

204. 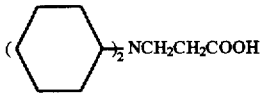

205. $(nBu)_2NCH_2CH_2COOH$

206. $HOCH_2CH_2\underset{\underset{2EH}{|}}{N}CH_2CH_2COOH$

207. $CH_3\overset{\overset{OH}{|}}{C}HCH\underset{\underset{2EH}{|}}{N}CH_2CH_2COOH$ 208. $HO(CH_2)_4\underset{\underset{2EH}{|}}{N}CH_2CH_2COOH$ 209. $H_3OCH_2CH_2\underset{\underset{2EH}{|}}{N}CH_2CH_2COOH$ 210. $H_3CH_2OCH_2CH_2\underset{\underset{2EH}{|}}{N}CH_2CH_2COOH$ 211. $ClCH_2CH_2\underset{\underset{2EH}{|}}{N}CH_2CH_2COOH$ 212. $NCCH_2CH_2\underset{\underset{2EH}{|}}{N}CH_2CH_2COOH$ 213. $CH_2{=}CHCH_2\underset{\underset{2EH}{|}}{N}CH_2CH_2COOH$ -continued 214. $HSCH_2CH_2\underset{\underset{2EH}{|}}{N}CH_2CH_2COOH$ 215. $CH_3SCH_2CH_2\underset{\underset{2EH}{|}}{N}CH_2CH_2COOH$ 216. $2EH\text{-}NH(CH_2)_4COOH$ 217. $2EH\text{-}NH(CH_2)_6COOH$ 218. 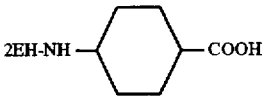

219. 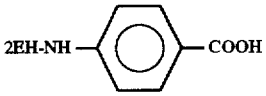

220. $2EH\text{-}NH(CH_2CH_2O)_4COOH$

221. $R-CH_2CH_2-R$

222. $R\text{-}(CH_2)_4\text{-}R$

223. $R\text{-}(CH_2)_6\text{-}R$

224. 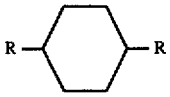

225. 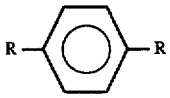

226. 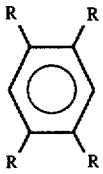

227. 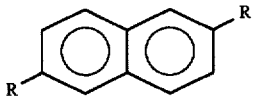

228. 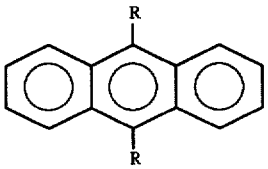

229. 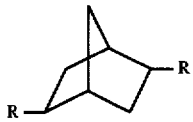

(The above R represents $-\underset{\underset{2EH}{|}}{N}CH_2CH_2COOH$.)

230. 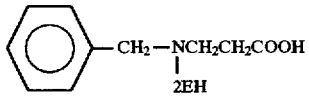

231. 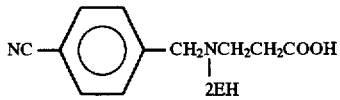

-continued

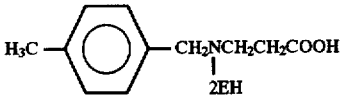

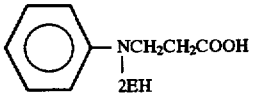

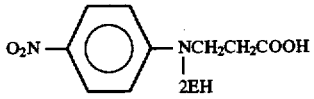

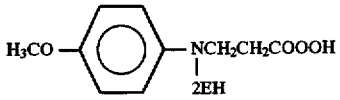

$(HOOCCH_2CH_2)_2NCH_2CH_2COO\text{-}2EH$ $HOOCCH_2CH_2NHCH_2CH_2COO\text{-}2EH$

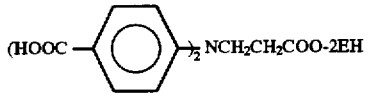

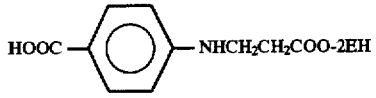

$HOOC(CH_2)_6NHCH_2CH_2COO\text{-}2EH$ $[HOOC(CH_2)_6]_2NCH_2CH_2COO\text{-}2EH$ $HOOCCH_2CH(COOH)NHCH_2CH_2COO\text{-}2EH$ $(2EH)_2NCH_2CH(COOH)CH_2COOH$

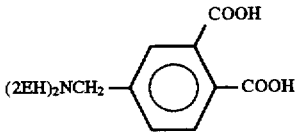

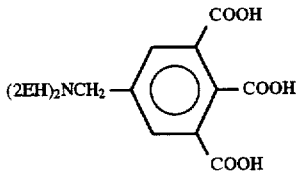

$(2EH)_2NCH_2CH_2CH(COOH)CH_2COOH$

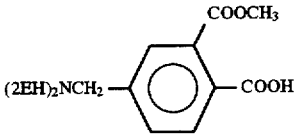

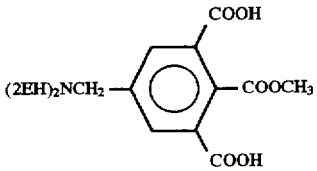

232. $nDode\text{-}NHCH_2CH(COOH)CH_2COOH$ 249.

233. $nDode\text{-}NHCH_2CH(COOCH_3)CH_2COOH$ 250.

Referring to the urea compounds represented by Formula (5) and/or the urethane compounds represented by Formula (6), each containing an amino group represented by Formula (4) and having an inorganic/organic value lying in the range of 0.1 to 4.0 inclusive, it is preferred that $R_7$ and $R_8$ each denote a hydrogen atom and/or a $C_{1-22}$ alkyl, cycloalkyl, alkenyl, aralkyl or aryl group which may have a substituent. Optionally, they may be combined with each other to form a ring. The above-mentioned substituent, for instance, may be hydroxide, carboxyl, alkoxy, ester, sulfide, amino, cyano or nitro groups and halogen atoms.

234. $a_1$, $a_2$ and $a_3$ each stand for a hydrogen atom and/or a $C_{1-18}$ organic residue, mentioned for $R_7$ and $R_8$, and X denotes an oxygen or sulfur atom.

235. More preferably, $R_7$ and $R_8$ each denote:

236. a $C_{1-18}$ alkyl group which may have a substituent which may have a substituent (for instance, methyl, ethyl, propyl, isopropyl, butyl, isobutyl, heptyl, hexyl, 2-ethylhexyl, octyl, decyl, dodecyl, hexadecyl, octadecyl, 2-hydroxyethyl, 2-hydroxypropyl, 3-hydroxypropyl, 4-hydroxybutyl, 2-hydroxybutyl, 2-methoxyethyl, 2-butoxyethyl, 2-ethoxyethyl, 4-methoxybutyl, methylthioethyl, methylthiobutyl, 2-aminoethyl, N,N'-dimethylaminoethyl, piperidinoethyl, pyrrolidinoethyl, 2-chloroethyl, 2-chlorobutyl, 2-bromoethyl, 2-cyanoethyl, 4-cyanobutyl, etc.), 237. an alkenyl group which may have a substituent (for instance, 2-methyl-1-propenyl, 2-butenyl, 2-pentenyl, 3-methyl- 2-pentenyl, 1-pentenyl, 1-hexenyl, 2-hexenyl, 4-methyl-2-hexenyl, vinyl, 2-propenyl, 3-butenyl, etc.), 238. an aralkyl group which may have a subsitituent (for instance, benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl, cyanobenzyl, nitrobenzyl, etc.), 239. a cycloalkyl group which may have a substituent (for instance, cyclopropyl, cyclobutyl, cyclopentyl, cyclohexyl, cycloheptyl, 4-methylcyclohexyl, 4-chlorocyclohexyl, 4-methoxycyclohexyl, 4-cyanocyclohexyl, etc.), and 240. an aryl group which may have a substituent (for instance, phenyl, tolyl, ethylphenyl, propylphenyl, chlorophenyl, fluorophenyl, bromophenyl, chloro-methyl-phenyl, dichlorophenyl, methoxyphenyl, cyanophenyl, acetamidophenyl, acetylphenyl, butoxyphenyl, etc.).

241. Optionally, $R_7$ and $R_8$ may be combined with each other to form a ring such as an aziridine, pyrrolidine, piperidine, morpholine or other ring.

242. $a_1$, $a_2$ and $a_3$ each denote:

243. a hydrogen atom and/or 244. a $C_{1-14}$ alkyl group which may have a substituent which may have a substituent (for instance, methyl, ethyl, propyl, isopropyl, butyl, isobutyl, heptyl, hexyl, 2-ethylhexyl, octyl, decyl, dodecyl, hexadecyl, octadecyl, 2-hydroxyethyl, 2-hydroxypropyl,

245.

246.

247.

248.

3-hydroxypropyl, 4-hydroxybutyl, 2-hydroxybutyl, 2-methoxyethyl, 2-butoxyethyl, 2-ethoxyethyl, 4-methoxybutyl, methylthioethyl, methylthiobutyl, 2-aminoethyl, N,N'-dimethylaminoethyl, piperidinoethyl, pyrrolidinoethyl, 2-chloroethyl, 2-chlorobutyl, 2-bromoethyl, 2-cyanoethyl, 4-cyanobutyl, etc.), an alkenyl group which may have a substituent (for instance, 2-methyl-1-property, 2-butenyl, 2-pentenyl, 3-methyl-2-pentenyl, 1-pentenyl, 1-hexenyl, 2-hexenyl, 4-methyl, 2-hexenyl, vinyl, 2-propenyl, 3-butenyl, etc.), an aralkyl group which may have a subsituent (for instance, benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl, cyanobenzyl, nitrobenzyl, etc.), a cycloalkyl group which may have a substituent (for instance, cyclopropyl, cyclobutyl, cyclopentyl, cyclohexyl, cycloheptyl, 4-methylcyclohexyl, 4-chlorocyclohexyl, 4-methoxycyclohexyl, 4-cyanocyclohexyl, etc.), and an aryl group which may have a substituent (for instance, phenyl, tolyl, ethylphenyl, propylphenyl, chlorophenyl, fluorophenyl, bromophenyl, chloro-methyl-phenyl, dichlorophenyl, methoxyphenyl, cyanophenyl, acetamidephenyl, acetylphenyl, butoxyphenyl, etc.).

It is noted that these compounds contain per molecule preferably 1 to 10, more preferably 1 to 6 amino groups, and per molecule preferably 1 to 10, more preferably 1 to 6 carboxyl groups and/or ester bonds.

Specific, but not exclusive, examples of the compounds used in this invention are enumerated below.

$(CH_3)_2N(CH_2)_3HNCONH\text{-}nHx$ 301.
$(CH_3)_2N(CH_2)_3HNCONH-(CH_2)_3CH_3$ 302.
$(CH_3)_2N(CH_2)_3HNCONH\text{-}2EH$ 303.
$(CH_3)_2N(CH_2)_3HNCONH\text{-}nDode$ 304.
$(CH_3)_2N(CH_2)_3HNCONH\text{-}nOctdec$ 305.
$(CH_3)_2N(CH_2)_3HNCONH-CH_2CH_3$ 306.

307.

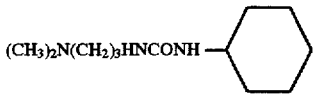

$(CH_3CH_2)_2N(CH_2)_3HNCONH\text{-}nHx$ 308.
$(CH_3CH_2)_2N(CH_2)_3HNCONH\text{-}2EH$ 309.
$(CH_3CH_2)_2N(CH_2)_3HNCONH-(CH_2)_3CH_3$ 310.
$(CH_3CH_2)_2N(CH_2)_3HNCONH\text{-}nDode$ 311.
$[(CH_3)_2CH]_2N(CH_2)_3HNCONH\text{-}nHx$ 312.

313.

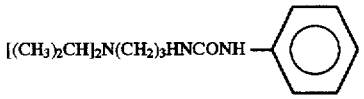

$(CH_3CH_2CH_2CH_2)_2N(CH_2)_3HNCONH\text{-}nHx$ 314.

$CH_3CH_2CH_2CH_2$ 315.
$N(CH_2)_3HNCONH\text{-}nHx$
$CH_3CH_2$ $(HOCH_2CH_2)_2N(CH_2)_3HNCONH\text{-}nHx$ 316.
$(HOCH_2CH_2)_2N(CH_2)_3HNCONH\text{-}nDode$ 317.

-continued $HOCH_2CH_2$ 318.
$N(CH_2)_3HNCONH\text{-}nDode$
$CH_3CH_2$ $(nHx)_2N(CH_2)_3HNCONH\text{-}nHx$ 319.
$(2EH)_2N(CH_2)_3HNCONH-(CH_2)_3CH_3$ 320.
$(CH_3CH_2CH_2)_2N(CH_2)_3HNCONH\text{-}nDode$ 321.

322.

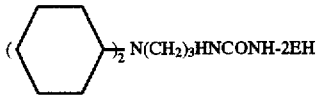

323.

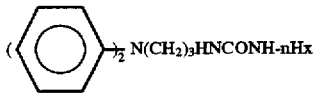

$(CH_2=CHCH_2)_2N(CH_2)_3HNCONH\text{-}nDode$ 324.
$(ClCH_2CH_2)_2N(CH_2)_3HNCONH\text{-}nDode$ 325.
$(HOOCCH_2CH_2)_2N(CH_2)_3HNCONH\text{-}nDode$ 326.
$(NCCH_2CH_2)_2N(CH_2)_3HNCONH\text{-}nDode$ 327.
$(H_3COCH_2CH_2)_2N(CH_2)_3HNCONH\text{-}nDode$ 328.

$CH_3N(CH_2)_3HNCONH\text{-}nDode$ 329.
H $H_2N(CH_2)_3HNCONH\text{-}nDode$ 330.

$CH_3CH_2N(CH_2)_3HNCONH\text{-}nDode$ 331.
H $(CH_3CH_2)_2N(CH_2)_2HNCONH\text{-}2EH$ 332.
$(CH_3CH_2)_2N(CH_2)_4HNCONH\text{-}2EH$ 333.
$(CH_3CH_2)_2N(CH_2)_6HNCONH\text{-}2EH$ 334.

335.

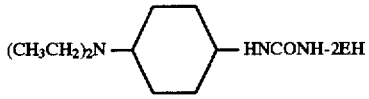

336.

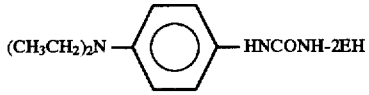

$(CH_3CH_2)_2N(CH_2CH_2O)_2HNCONH\text{-}nDode$ 337.

$(CH_3CH_2)_2N(CH_2CH_2O)_4HNCONH\text{-}nDode$ 338.

339.

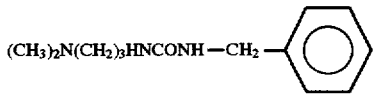

340.

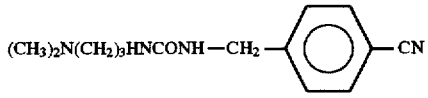

341.

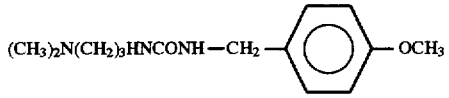

342.

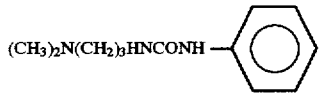

343.

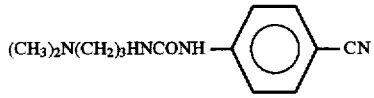

-continued

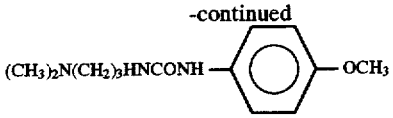

344.

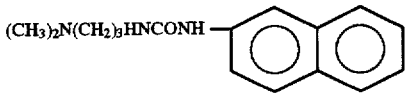

345.

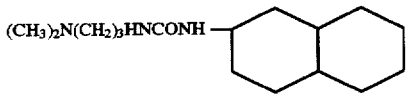

346.

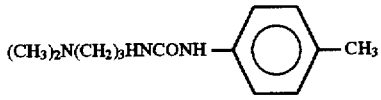

347.

$R-CH_2CH_2-R$ 348.

$R-(CH_2)_4-R$ 349.

$R-(CH_2)_6-R$ 350.

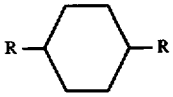

351.

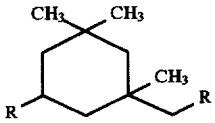

352.

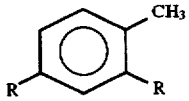

353.

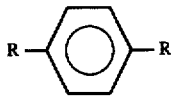

354.

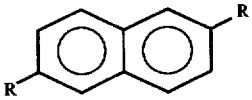

355.

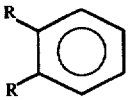

356.

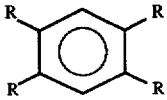

357.

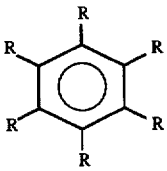

358.

$R\leftarrow CH_2CH_2O\rightarrow_2 R$ 359.

$R\leftarrow CH_2CH_2O\rightarrow_4 R$ 360.

$R\leftarrow CH_2CH_2NH\rightarrow_4 R$ 361.

(The above R represents $(CH_3)_2N(CH_2)_3HNCONH-$.)

$2EH\text{-}N[CH_2CH_2HNCONH\text{-}nHx]_2$ 362.

-continued $2EH\text{-}N[\leftarrow CH_2\rightarrow_3 HNCONH\text{-}nHx]_2$ 363.

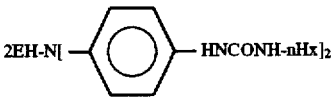

364.

$[2EH\text{-}HNCONHCH_2CH_2]_3N$ 365.

$[nBu\text{-}HNCONHCH_2CH_2]_3N$ 366.

$2EH\text{-}N[\leftarrow CH_2CH_2O\rightarrow_2 HNCONH\text{-}nHx]$ 367.

$nDode\text{-}N[\leftarrow CH_2CH_2O\rightarrow_4 HNCONH\text{-}nHx]$ 368.

$[nDode\text{-}HNCONHCH_2CH_2]_3N$ 369.

$[nDode\text{-}HNCONH\leftarrow OCH_2CH_2\rightarrow_4]_3N$ 370.

$(CH_3)_2N(CH_2)_3OCONH\text{-}nHx$ 371.

$(CH_3)_2N(CH_2)_3OCONH-(CH_2)_3CH_3$ 372.

$(CH_3)_2N(CH_2)_3OCONH\text{-}2EH$ 373.

$(CH_3)_2N(CH_2)_3OCONH\text{-}nDode$ 374.

$(CH_3)_2N(CH_2)_3OCONH\text{-}nOctdec$ 375.

$(CH_3)_2N(CH_2)_3OCONH-CH_2CH_3$ 376.

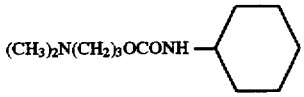

377.

$(CH_3CH_2)_2N(CH_2)_3OCONH\text{-}nHx$ 378.

$(CH_3CH_2)_2N(CH_2)_3OCONH\text{-}2EH$ 379.

$(CH_3CH_2)_2N(CH_2)_3OCONH\text{-}nDode$ 380.

$(CH_3CH_2)_2N(CH_2)_3OCONH-(CH_2)_3CH_3$ 381.

$[(CH_3)_2CH]_2N(CH_2)_3OCONH\text{-}nHx$ 382.

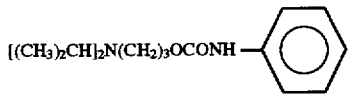

383.

$(CH_3CH_2CH_2CH_2)_2N(CH_2)_3OCONH\text{-}nHx$ 384.

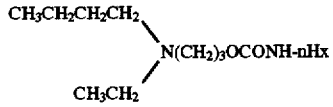

385.

$(HOCH_2CH_2)_2N(CH_2)_3OCONH\text{-}nDode$ 386.

$(HOCH_2CH_2)_2N(CH_2)_3OCONH\text{-}2EH$ 387.

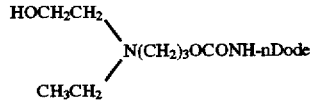

388.

$(nHx)_2N(CH_2)_3OCONH\text{-}nHx$ 389.

$(2EH)_2N(CH_2)_3OCONH-(CH_2)_3CH_3$ 390.

$(CH_3CH_2CH_2)_2N(CH_2)_3OCONH\text{-}nDode$ 391.

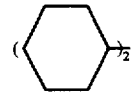

392.

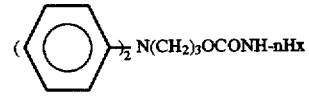

393.

$(CH_2=CHCH_2)_2N(CH_2)_3OCONH\text{-}nDode$ 394.

$(ClCH_2CH_2)_2N(CH_2)_3OCONH\text{-}nDode$ 395.

$(HOOCCH_2CH_2)_2N(CH_2)_3OCONH\text{-}nDode$ 396.

$(NCCH_2CH_2)_2N(CH_2)_3OCONH\text{-}nDode$ 397.

$(H_3COCH_2CH_2)_2N(CH_2)_3OCONH\text{-}nDode$ 398.

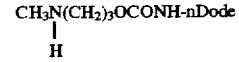

399.

-continued

400. $CH_3CH_2N(H)(CH_2)_3OCONH\text{-}nDode$

401. $H_2N(CH_2)_3OCONH\text{-}nDode$

402. $CH_3CH_2N(H)(CH_2)_3OCONH\text{-}nDode$

403. $(CH_3CH_2)_2N(CH_2)_3OCONH\text{-}2EH$

404. $(CH_3CH_2)_2N(CH_2)_4OCONH\text{-}2EH$

405. $(CH_3CH_2)_2N(CH_2)_6OCONH\text{-}2EH$

406. 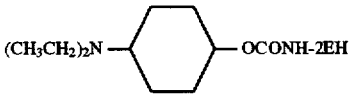

407. 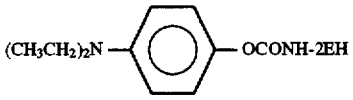

408. $(CH_3CH_2)_2N(CH_2CH_2O)_2CONH\text{-}nDode$

409. 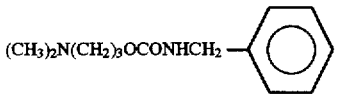

410. 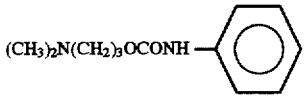

411. 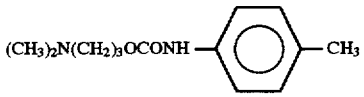

412. 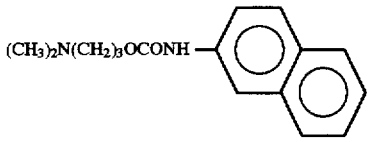

413. $R-CH_2CH_2-R$

414. 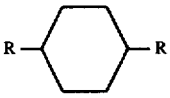

415. 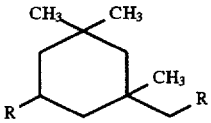

416. 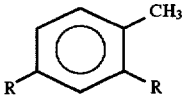

417. 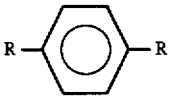

418. 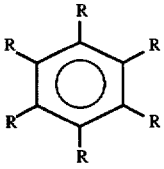

419. 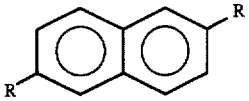

420. $R(CH_2CH_2O)_2R$ (The above R represents $(CH_3)_2N(CH_2)_3OCONH-$.)

421. $2EH\text{-}N[CH_2CH_2OCONH\text{-}nHx]_2$

422. 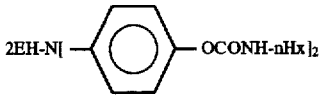

423. $[2EH\text{-}HNCOOCH_2CH_2]_3N$

424. $[nBu\text{-}HNCOOCH_2CH_2]_3N$

425. $nDode\text{-}N[(CH_2CH_2O)_2CONH\text{-}nHx]_2$

426. $[nDode\text{-}HNCO(OCH_2CH_2)_2]_3N$

427. $(CH_3)_2N(CH_2)_3HNCONHSO_2\text{-}nHx$

428. $(CH_3)_2N(CH_2)_3HNCONHSO_2\text{-}2EH$

429. $(CH_3)_2N(CH_2)_3HNCONHSO_2\text{-}nDode$

430. 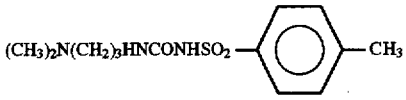

431. 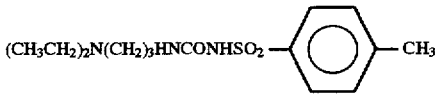

432. 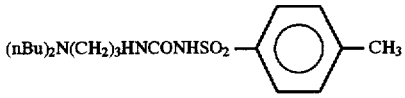

433. $R-CH_2CH_2-R$

434. 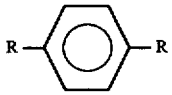

435. 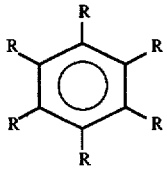

(The above R represents $(CH_3CH_2)_2N(CH_2)_3HNCONHSO_2-$.)

436. $(CH_3)_2N(CH_2)_3OCONHSO_2\text{-}nHx$

437. 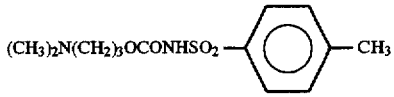

438. $(CH_3)_2N(CH_2)_3OCONHSO_2\text{-}nDode$

-continued

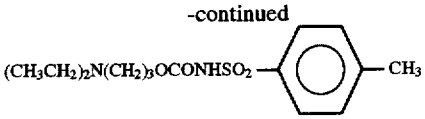

$(CH_3CH_2)_2N(CH_2)_3OCONHSO_2-$ $-CH_3$ $R-CH_2CH_2-R$

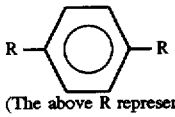

(The above R represents $(CH_3CH_2)_2N(CH_2)_3OCONHSO_2-$.)

$(CH_3)_2N(CH_2)_3HNCSNH$-nHx
$(CH_3)_2N(CH_2)_3HNCSNH$-nDode

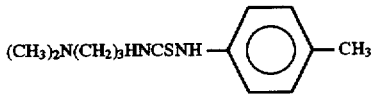

$(CH_3)_2N(CH_2)_3HNCSNH-$ $-CH_3$ $(CH_3CH_2)_2N(CH_2)_3HNCSNH$-nHx
$(nBu)_2N(CH_2)_3HNCSNH$-2EH
$(nHx)_2N(CH_2)_3HNCSNH$-2EH
$(HOCH_2CH_2)_2N(CH_2)_3HNCSNH$-2EH
$R-CH_2CH_2-R$

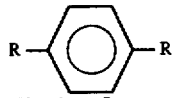

(The above R represents $(CH_3)_2N(CH_2)_3HNCSNH-$.)

$(CH_3)_2N(CH_2)_3HNCSNHSO_2$-nHx

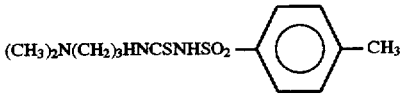

$(CH_3)_2N(CH_2)_3HNCSNHSO_2-$ $-CH_3$

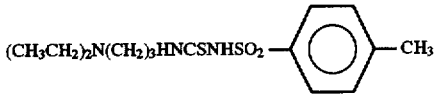

$(CH_3CH_2)_2N(CH_2)_3HNCSNHSO_2-$ $-CH_3$ $(CH_3)_2N(CH_2)_3OCSNH$-nHx
$(CH_3)_2N(CH_2)_3OCSNH$-nDode

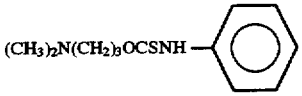

$(CH_3)_2N(CH_2)_3OCSNH-$ $(CH_3CH_2)_2N(CH_2)_3OCSNH$-nHx
$(nBu)_2N(CH_2)_3OCSNH$-nHx

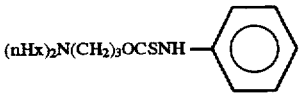

$(nHx)_2N(CH_2)_3OCSNH-$ $R-CH_2CH_2-R$

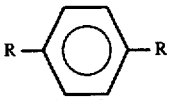

(The above R represents $(CH_3)_2N(CH_2)_3OCSNH-$.)

$(CH_3)_2N(CH_2)_3OCSNHSO_2$-nHx

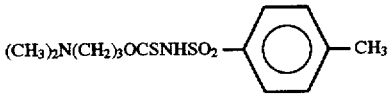

$(CH_3)_2N(CH_2)_3OCSNHSO_2-$ $-CH_3$

-continued

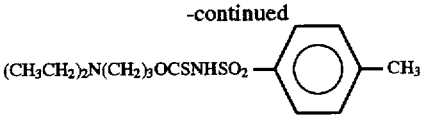

$(CH_3CH_2)_2N(CH_2)_3OCSNHSO_2-$ $-CH_3$

Referring to the amide and/or imide compounds represented by Formulae (8) and (9), respectively, each containing an amino Group represented by Formula (7) and having an inorganic/organic value lying in the range of 0.1 to 4.0 inclusive, it is preferred that $R_9$ and $R_{10}$ each denote a hydrogen atom and/or a $C_{1-22}$ alkyl, cycloalkyl, alkenyl, aralkyl or aryl group which may have a substituent. Optionally, they may be combined with each other to form a ring. The above-mentioned substituent, for instance, may be hydroxide, carboxyl, alkoxy, sulfide, amino, cyano, nitro or ester groups and halogen atoms.

$a_4$ and $a_5$ each stand for a hydrogen atom and/or a $C_{1-18}$ organic residue, mentioned for $R_9$ and $R_{10}$.

More preferably, $R_9$ and $R_{10}$ each denote:

a $C_{1-18}$ alkyl group which may have a substituent which may have a substituent (for instance, methyl, ethyl, propyl, isopropyl, butyl, isobutyl, heptyl, hexyl, 2-ethylhexyl, octyl, decyl, dodecyl, hexadecyl, octadecyl, 2-hydroxyethyl, 2-hydroxypropyl, 3-hydroxypropyl, 4-hydroxybutyl, 2-hydroxybutyl, 2-methoxyethyl, 2-butoxyethyl, 2-ethoxyethyl, 4-methoxybutyl, methylthioethyl, methylthiobutyl, 2-aminoethyl, N,N'-dimethylaminoethyl, piperidinoethyl, pyrrolidinoethyl, 2-chloroethyl, 2-chlorobutyl, 2-bromoethyl, 2-cyanoethyl, 4-cyanobutyl, etc.), an alkenyl group which may have a substituent (for instance, 2-methyl-1-propenyl, 2-butenyl-2-pentenyl, 3-methyl-2-pentenyl, 1-pentenyl, 1-hexenyl, 2-hexenyl, 4-methyl-2-hexenyl, vinyl, 1-propenyl,3-butenyl, etc.), an aralkyl group which may have a subsitituent (for instance, benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl, cyanobenzyl, nitrobenzyl, etc.), a cycloalkyl group which may have a substituent (for instance, cyclopropyl, cyclobutyl, cyclopentyl, cyclohexyl, cycloheptyl, 4-methylcyclohexyl, 4-chlorocyclohexyl, 4-methoxycyclohexyl, 4-cyanocyclohexyl, etc.), and an aryl group which may have a substituent (for instance, phenyl, tolyl, ethylphenyl, propylphenyl, chlorophenyl, fluorophenyl, bromophenyl, chloro-methyl-phenyl, dichlorophenyl, methoxyphenyl, cyanophenyl, acetamidophenyl, acetylphenyl, butoxyphenyl, etc.).

Optionally, $R_9$ and $R_{10}$ may be combined with each other to form a ring such as an aziridine, pyrrolidine, piperidine, morpholine or other ring.

$a_4$ and $a_5$ each denote:

a hydrogen atom and/or a $C_{1-18}$ alkyl group which may have a substituent which may have a substituent (for instance, methyl, ethyl, propyl, isopropyl, butyl, isobutyl, heptyl, hexyl, 2-ethylhexyl, octyl, decyl, dodecyl, hexadecyl, octadecyl, 2-hydroxyethyl, 2-hydroxypropyl, 3-hydroxypropyl, 4-hydroxybutyl, 2-hydroxybutyl, 2-methoxyethyl, 2-butoxyethyl, 2-ethoxyethyl, 4-methoxybutyl, methylthioethyl, methylthiobutyl, 2-aminoethyl, N,N'-dimethylaminoethyl, piperidinoethyl, pyrrolidinoethyl, 2-chloroethyl, 2-chlorobutyl, 2-bromoethyl, 2-cyanoethyl, 4-cyanobutyl, N,N'-dimethylaminopropyl, N,N'-diethylaminopropyl, N,N'-di-n-propylaminopropyl, N,N'-diisopropylaminopropyl, N,N'-di-n-butylaminopropyl, N,N'-di-n-hexylaminopropyl, N,N'-diethanolaminopropyl, N,N'-diisopropanolaminobutyl, etc.), an alkenyl group which may have a substituent (for instance, 2-methyl-1-propenyl, 2-butenyl, 2-pentenyl, 3-methyl-2-pentenyl, 1-pentenyl, 1-hexenyl, 2-hexenyl, 4-methyl-2-hexenyl, vinyl, 2-propenyl, 3-butenyl, etc.), an aralkyl group which may have a subsituent (for instance, benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl, cyanobenzyl, nitrobenzyl, etc.), a cycloalkyl group which may have a substituent (for instance, cyclopropyl, cyclobutyl, cyclopentyl, cyclohexyl, cycloheptyl, 4-methylcyclohexyl, 4-chlorocyclohexyl, 4-methoxycyclohexyl, 4-cyanocyclohexyl, etc.), an aryl group which may have a substituent (for instance, phenyl, tolyl, ethylphenyl, propylphenyl, chlorophenyl, fluorophenyl, bromophenyl, chloro-methyl-phenyl, dichlorophenyl, methoxyphenyl, cyanophenyl, acetamidophenyl, acetylphenyl, butoxyphenyl, etc.), a hydroxide group, and a halogen atom such as a chlorine, bromine or iodine atom.

It is noted that these compounds contain per molecule preferably 1 to 10, more preferably 1 to 6 amino groups, and per molecule preferably 1 to 10, more preferably 1 to 6 amide and/or imide bonds.

Specific, but not exclusive, examples of the compounds used in the present invention are enumerated below.

501. $(CH_3CH_2)_2N(CH_2)_3NHCO$-nDode
502. $(CH_3CH_2)_2N(CH_2)_3NHCO$-nOctdec
503. $(CH_3CH_2)_2N(CH_2)_3NHCO$-2EH
504. $(CH_3CH_2)_2N(CH_2)_3NHCO$-nHx 505. $(CH_3CH_2)_2N(CH_2)_3NHCO$ 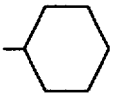

506. $(CH_3CH_2)_2N(CH_2)_3NHCO$-nOct
507. $(CH_3CH_2)_2N(CH_2)_3NHCO$-nBu

508. $(CH_3CH_2)_2N(CH_2)_3NHCO$ 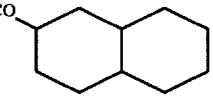

509. $(CH_3CH_2)_2N(CH_2)_3NHCO$ 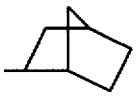

510. $(CH_3CH_2)_2N(CH_2)_3NHCO-CH_2$ 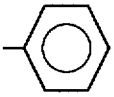

511. $(CH_3CH_2)_2N(CH_2)_3NHCO$ 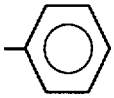

-continued

512. $(CH_3CH_2)_2N(CH_2)_3NHCO$ 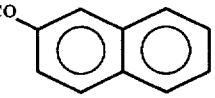

513. $(CH_3)_2N(CH_2)_3NHCO$-nDode
514. $(CH_3CH_2CH_2)_2N(CH_2)_3NHCO$-nDode
515. $(nBu)_2N(CH_2)_3NHCO$-nDode
516. $[(CH_3)_2CH]_2N(CH_2)_3NHCO$-nDode
517. $(nHx)_2N(CH_2)_3NHCO$-2EH
518. $(2EH)_2N(CH_2)_3NHCO$-nBu
519. $(HOCH_2CH_2)_2N(CH_2)_3NHCO$-nDode 520. $(CH_3\overset{OH}{\overset{|}{C}}HCH_2)_2N(CH_2)_3NHCO$-nDode 521. $[HO(CH_2)_4]_2N(CH_2)_3NHCO$-nDode 522. $HOCH_2CH_2\underset{\underset{CH_2CH_3}{|}}{N}(CH_2)_3NHCO$-nDode 523. $HOCH_2CH_2\underset{\underset{nBu}{|}}{N}(CH_2)_3NHCO$-nDode 524. $(ClCH_2CH_2)_2N(CH_2)_3NHCO$-nDode
525. $(BrCH_2CH_2)_2N(CH_2)_3NHCO$-nDode
526. $(NCCH_2CH_2)_2N(CH_2)_3NHCO$-nDode
527. $(O_2NCH_2CH_2)_2N(CH_2)_3NHCO$-nDode 528. ( 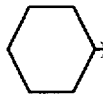 $)_2$ $N(CH_2)_3NHCO$-nDode 529. $(CH_2{=}CHCH_2)_2N(CH_2)_3NHCO$-nDode 530. ( 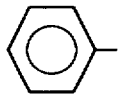 $CH_2)_2N(CH_2)_3NHCO$-nDode 531. (NC 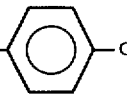 $CH_2)_2N(CH_2)_3NHCO$-nDode 532. ($H_3C$ 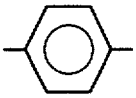 $CH_2)_2N(CH_2)_3NHCO$-nDode 533. ( 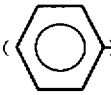 $)_2$ $N(CH_2)_3NHCO$-nDode 534. ($O_2N$ 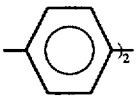 $)_2$ $N(CH_2)_3NHCO$-nDode 535. ($H_3C$ 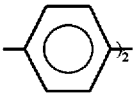 $)_2$ $N(CH_2)_3NHCO$-nDode 536. $CH_3NH(CH_2)_3NHCO$-nDode
537. $CH_3CH_2NH(CH_2)_3NHCO$-nDode
538. $(CH_3)_2CHNH(CH_2)_3NHCO$-nDode
539. $nH_x-NH(CH_2)_3NHCO$-nDode
540. $2EH-NH(CH_2)_3NHCO$-nDode
541. $HOCH_2CH_2NH(CH_2)_3NHCO$-nDode 542. $CH_3\overset{OH}{\overset{|}{C}}H_2CH_2NH(CH_2)_3NHCO$-nDode -continued 543. $(CH_3CH_2)_2NCH_2NHCO$-nDode
544. $(CH_3CH_2)_2N(CH_2)_2NHCO$-nDode
545. $(CH_3CH_2)_2N(CH_2)_4NHCO$-nDode
546. $(CH_3CH_2)_2N(CH_2)_6NHCO$-nDode 547. $(CH_3CH_2)_2N$ 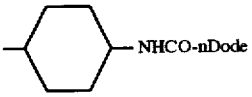 NHCO-nDode 548. $(CH_3CH_2)_2N$ 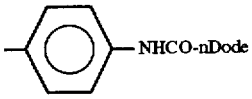 NHCO-nDode 549. $(CH_3CH_2)_2N$ 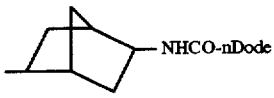 NHCO-nDode 550. $(CH_3CH_2)_2N$ 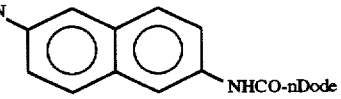 NHCO-nDode

551. $R-CH_2CH_2-R$ 552. $R-(CH_2)_4-R$
553. $R-(CH_2)_6-R$

554. R 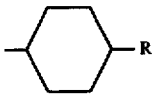 R 555. R 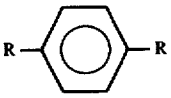 R

556. R 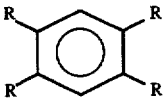 R 557. R 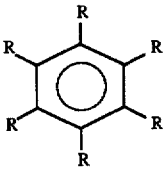 R

558. 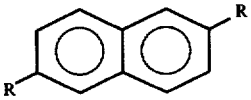

559. 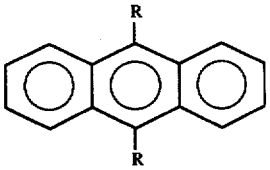

560. 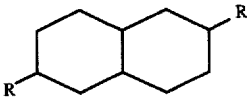

561. 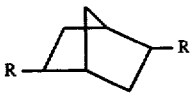

562. $R-CH_2CH_2OCH_2CH_2-R$
563. $R-CH_2CH_2NHCH_2CH_2-R$ (The above R represents $(nHx)_2N(CH_2)_3NHCO-$.)

564. 2EH—$NHCH_2CH_2N$ 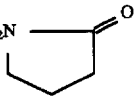

-continued 565. nHx-$NHCH_2CH_2N$ 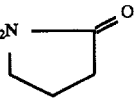

566. nDode-$NHCH_2CH_2N$ 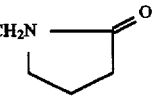

567. $(2EH)_2NCH_2CH_2N$ 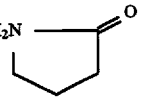

568. $(nHx)_2NCH_2CH_2N$ 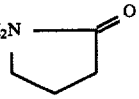

569. 2EH—$NHCH_2CH_2N$ 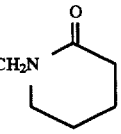

570. $(2EH)_2NCH_2CH_2N$ 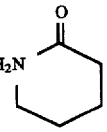

571. 2EH—$NCH_2CH_2N$ 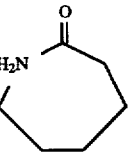

572. $(2EH)_2NCH_2CH_2N$ 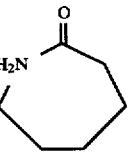

573. 2EH—$NHCH_2CH_2N$ 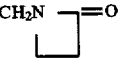

574. $(2EH)_2NCH_2CH_2N$ 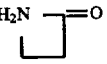

575. $(CH_3)_2N(CH_2)_3N$ 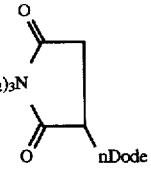 nDode

576. $(CH_3)_2N(CH_2)_3N$ 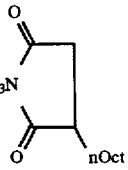 nOct

-continued
577. $(CH_3)_2N(CH_2)_3N$
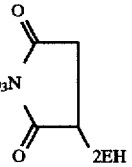
578. $(CH_3)_2N(CH_2)_3N$
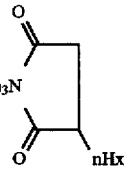
579. $(CH_3)_2N(CH_2)_3N$
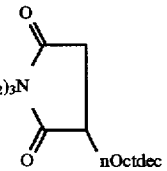
580. $(CH_3)_2N(CH_2)_3N$
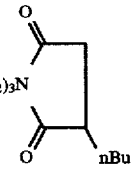
581. $(CH_3CH_2)_2N(CH_2)_3N$
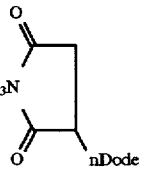
582. $[(CH_3)_2CH]_2N(CH_2)_3N$
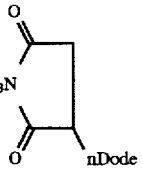
583. $(nBu)_2N(CH_2)_3N$
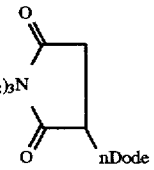
584. $(nHx)_2N(CH_2)_3N$
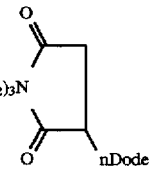
585. $(HOCH_2CH_2)_2N(CH_2)_3N$
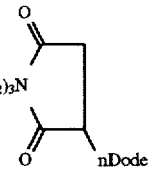
-continued
586. $(CH_3)_2N(CH_2)_3N$
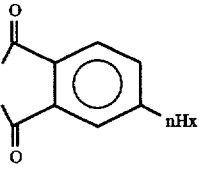
587. $(CH_3)_2N(CH_2)_3N$
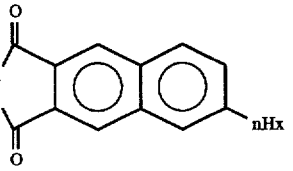
588. $(CH_3)_2N(CH_2)_3N$
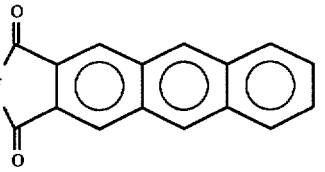
589. $(CH_3)_2N(CH_2)_3N$
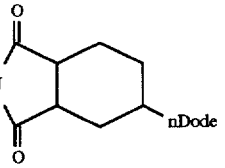
590. $(CH_3)_2N(CH_2)_3N$
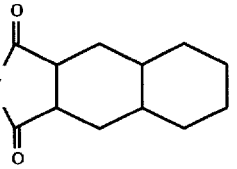
591. $(CH_3)_2N(CH_2)_3N$
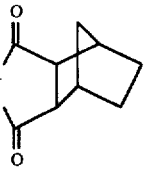
592. nDode-N
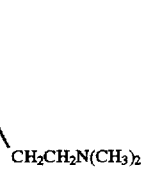
593. nDode-N
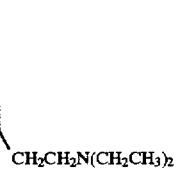
594. nDode-N
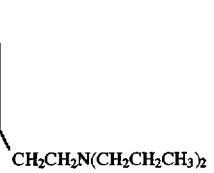

-continued
595. nDode-N
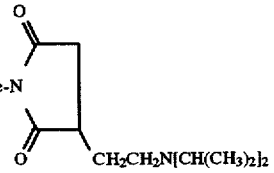
596. nDode-N
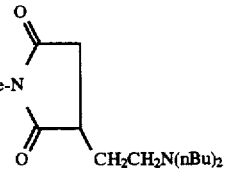
597. nDode-N
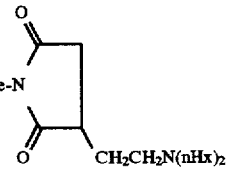
598. nDode-N
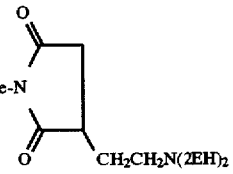
599. nDode-N
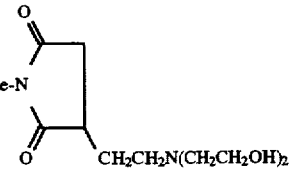
600. nDode-N
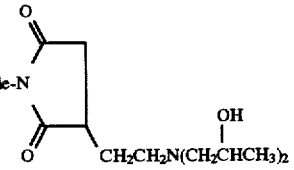
601. nDode-N
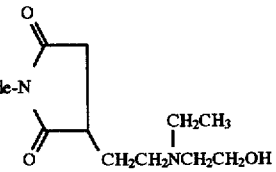
602. nDode-N
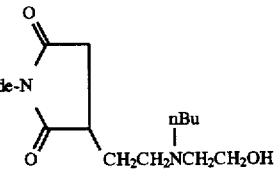
603. nDode-N
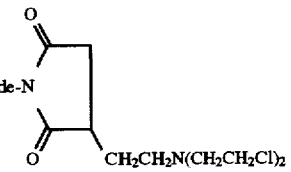
-continued
604. nDode-N
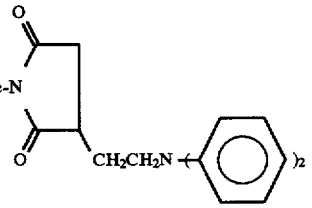
605. nDode-N
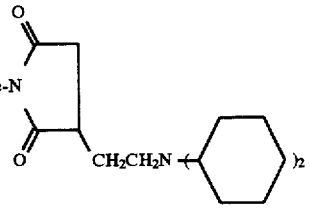
606. nDode-N
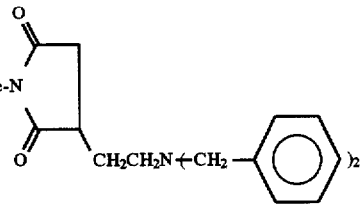
607. nDode-N
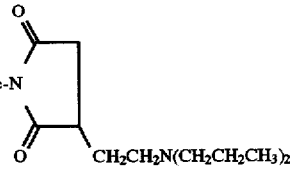
608. nDode-N
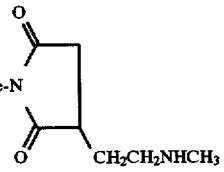
609. nDode-N
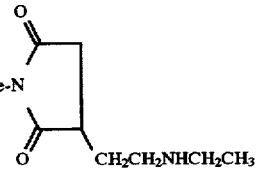
610. nDode-N
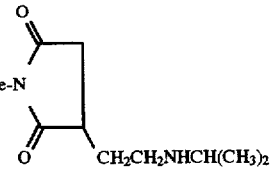
611. nDode-N
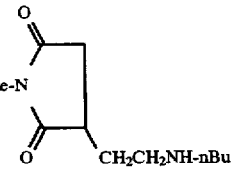

-continued
612. nDode-N
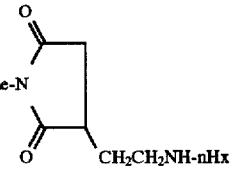
613. nDode-N
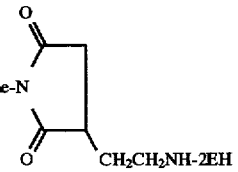
614. 2EH—N
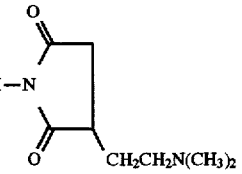
615. nHx-N
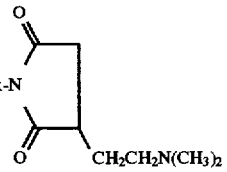
616. nBu-N
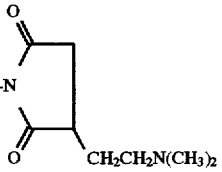
617. nOctdec-N
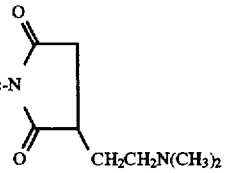
618.
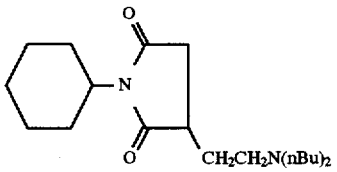
619.
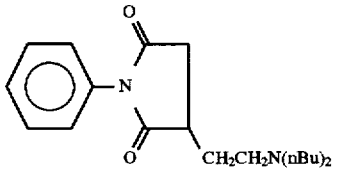
620. HO—N
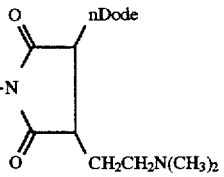
-continued
621. Br—N
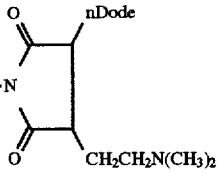
622. R—$CH_2CH_2$—R 623. R—$(CH_2)_4$—R
624. R—$(CH_2)_6$—R
625. R
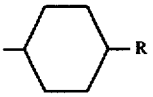
626. R
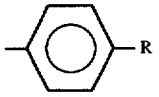
627. R
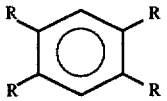
628. R
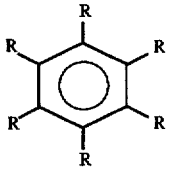
(The above R represents —N
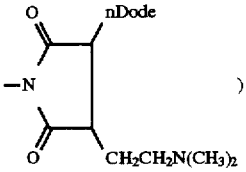
)
629. nDode-N
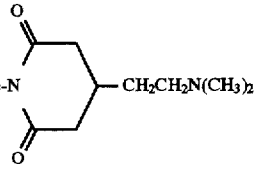
630. nDode-N
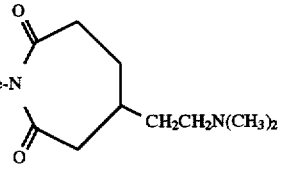
631. $(CH_3)_2N(CH_2)_3N$
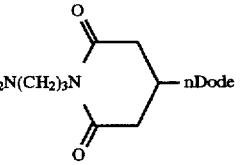
632. $(CH_3)_2N(CH_2)_3N$
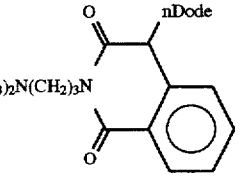
633. $(CH_3)_2N(CH_2)_3N$
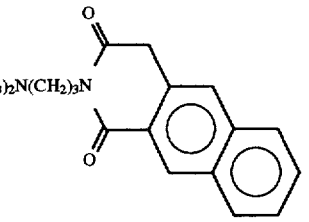

-continued

634. $(CH_3)_2N(CH_2)_3N$

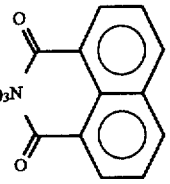

635. $(CH_3)_2N(CH_2)_3N$

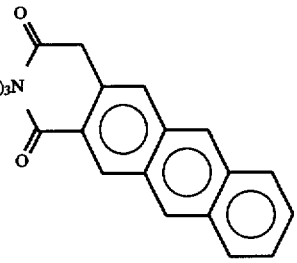

It is preferred that the heterocyclic compounds containing at least one nitrogen atom and having an inorganic/organic value lying in the range of 0.1 to 4.0 inclusive are aromatic and/or aliphatic, nitrogen-containing heterorings which may have a 3 to 10-membered ring substituent.

More preferable example of these compounds are aziridine, acetidine, pyrrolidine, piperidine, morpholine, piperazine, pyrrole, pyridine, pyridazine, pyrimidine, pyrazine, imidazole, oxazole, pyrazole, thiazole, isoxazole, isothiazole, indole, triazole, tetrazole, quinoline and other like rings.

The above-mentioned substituent, for instance, may be a hydrogen atom, a $C_{1-22}$ organic residue which may have a substituent, a hydroxide group, a carboxyl group, a carbonyl group, an amino group and a halogen atom.

It is preferred that the organic residue is:

a $C_{1-18}$ alkyl group which may have a substituent (for instance, methyl, ethyl, propyl, isopropyl, butyl, isobutyl, heptyl, hexyl, 2-ethylhexyl, octyl, decyl, dodecyl, hexadecyl, octadecyl, 2-hydroxyethyl, 2-hydroxypropyl, 3-hydroxypropyl, 4-hydroxybutyl, 2-hydroxybutyl, 2-methoxyethyl, 2-butoxyethyl, 2-ethoxyethyl, 4-methoxybutyl, methylthioethyl, methylthiobutyl, 2-aminoethyl, N,N'-dimethylaminoethyl, piperidinoethyl, pyrrolidinoethyl, 2-chloroethyl, 2-chlorobutyl, 2-bromoethyl, 2-cyanoethyl, 4-cyanobutyl, etc.), an alkenyl group which may have a substituent (for instance, 2-methyl-1-propenyl, 2-butenyl, 2-pentenyl, 3-methyl-2-pentenyl, 1-pentenyl, 1-hexenyl, 2-hexenyl, 4-methyl-2-hexenyl, vinyl, 2-propenyl, 3-butenyl, etc.), an aralkyl group which may have a subsitituent (for instance, benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl, cyanobenzyl, nitrobenzyl, etc.), a cycloalkyl group which may have a substituent (for instance, cyclopropyl, cyclobutyl, cyclopentyl, cyclohexyl, cycloheptyl, 4-methylcyclohexyl, 4-chlorocyclohexyl, 4-methoxycyclohexyl, 4-cyanocyclohexyl, etc.), and an aryl group which may have a substituent (for instance, phenyl, tolyl, ethylphenyl, propylphenyl, chlorophenyl, fluorophenyl, bromophenyl, chloro-methyl-phenyl, dichlorophenyl, methoxyphenyl, cyanophenyl, acetamidophenyl, acetylphenyl, butoxyphenyl, etc.).

It is noted that these heterocyclic compounds have per molecule preferably 1 to 10, more preferably 1 to 6 heterocyclic rings.

Specific, but not exclusive, examples of the heterocyclic compounds containing at least one nitrogen atom are enumerated below.

701. 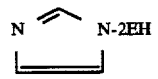

702. 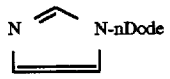

703. 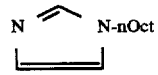

704. 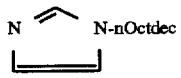

705. 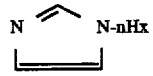

706. 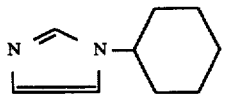

707. 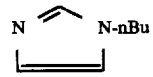

708. 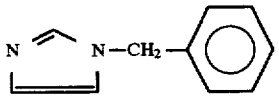

709. 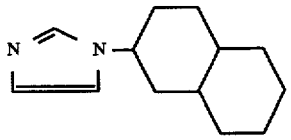

710. 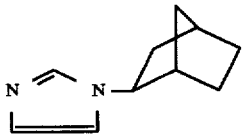

711. 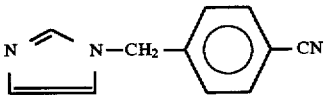

712. 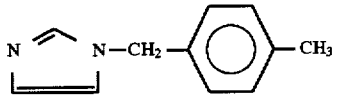

713. 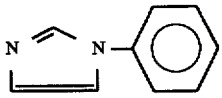

-continued
714.
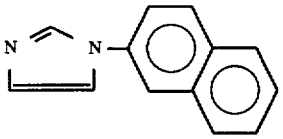
715.
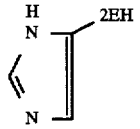
716.
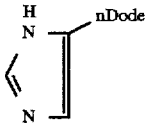
717.
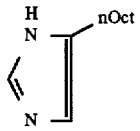
718.
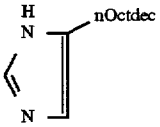
719.
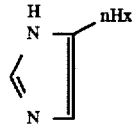
720.
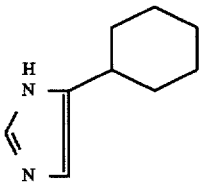
721.
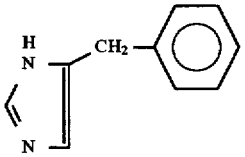
722.
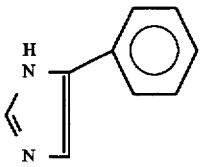
723.
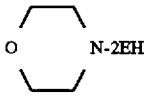
724.
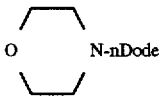
-continued
725.
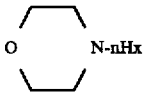
726.
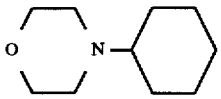
727.
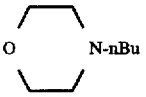
728.
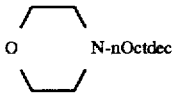
729.
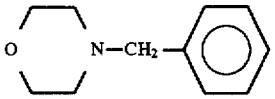
730.
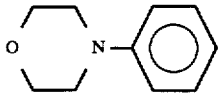
731.
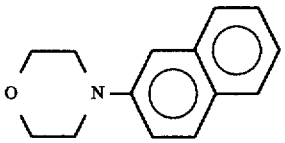
732.
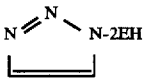
733.
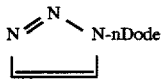
734.
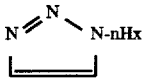
735.
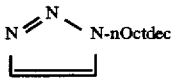
736.
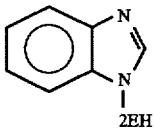
737.
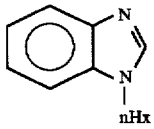
738.
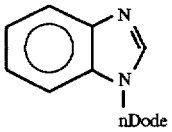

-continued
739.
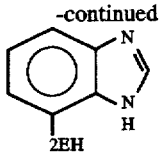
740.
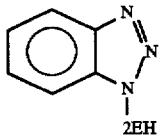
741.
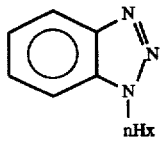
742.
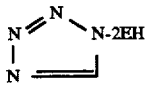
743.
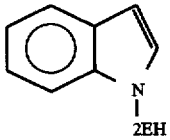
744.
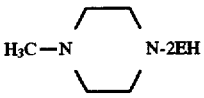
745.
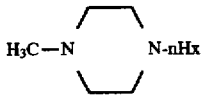
746.
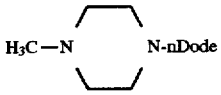
747.
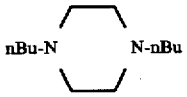
748.
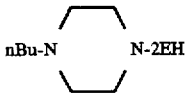
749.
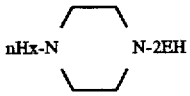
750.
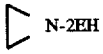
751.
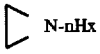
752.
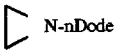
753.
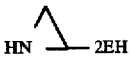
-continued
754.
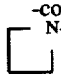
755.
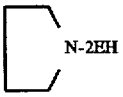
756.
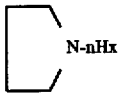
757.
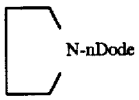
758.
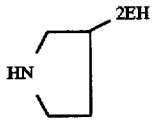
759.
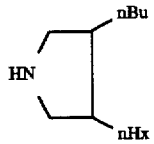
760.
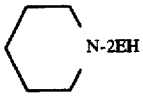
761.
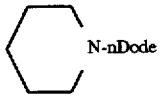
762.
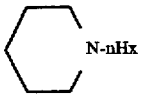
263.
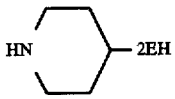
264.
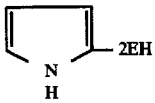
265.
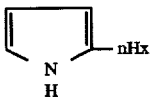
266.
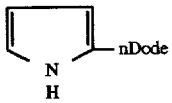
267.
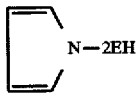
768.
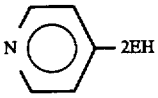

-continued
769.
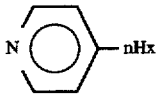
770.
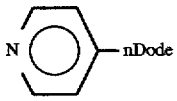
771.
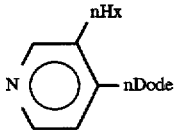
772.
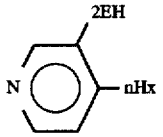
773.
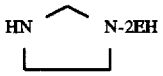
774.
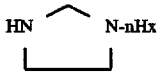
775.
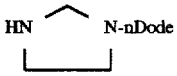
776.
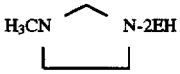
777.
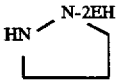
778.
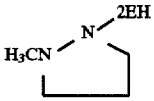
779.
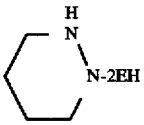
780.
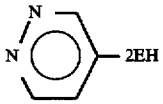
781.
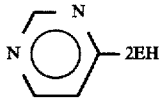
782.
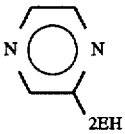
-continued
783.
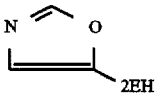
784.
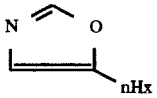
785.
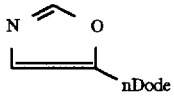
786.
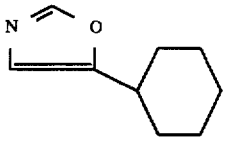
787.
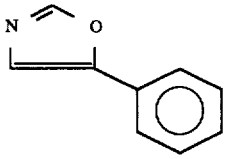
788.
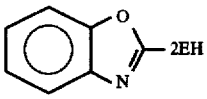
789.
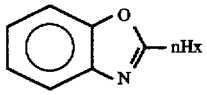
790.
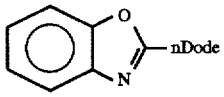
791.
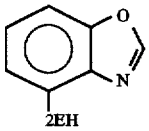
792.
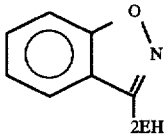
793.
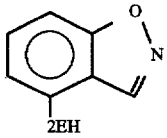
794.
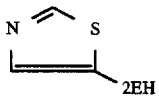
795.
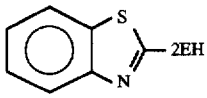

-continued

796.

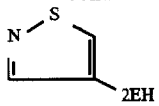

797.

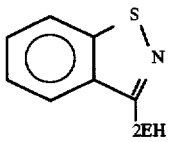

798.

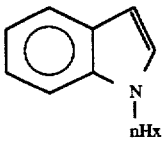

799.

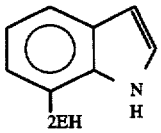

800.

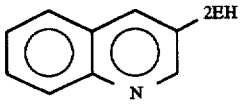

801.

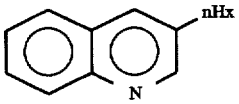

802.

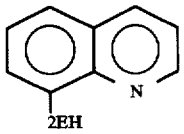

803.

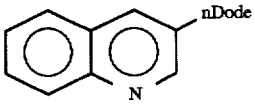

804.

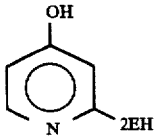

805.

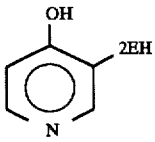

806.

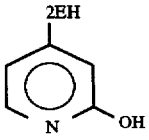

807.

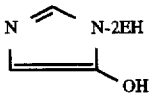

-continued

808.

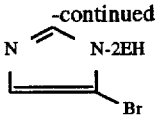

809.

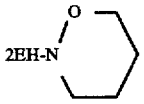

810.

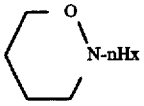

811.

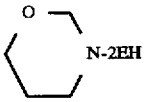

812.

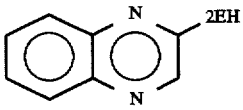

813.

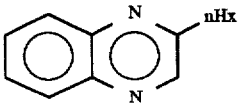

814.

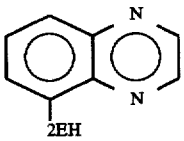

The amine compounds according to this invention may be synthesized by suitable reactions set forth in "Shin Jikken Kagaku Koza 14", published by Maruzen Co., Ltd. (1978) and "J. Am. Chem. Soc.", 72, 3073 (1950) such as SN2 type reactions between amines and halogenized alkyl compounds, SN2 type reactions between heterocyclic rings and halogenized alkyl compounds, reductive amination reactions between amines and carbonyl compounds, amine Michael addition reactions with double bonds, esterification reactions between acid chlorides and alcohols, esterification reactions between carboxylates and halogen compounds, hydrolysis reactions of esters, reactions between amine compounds and isocyanates, reactions between alkanolamines and isocyanate compounds and Gabriel reactions between phthalimide and halogenized alkyl compounds.

Referring now to the amounts of the constituents used per 1000 parts by weight of the treating solution of this invention, the phytic acid and phytate capable of forming a chelate compound with zinc ions lies in the range of 10 to 300 parts by weight, preferably 30 to 100 parts by weight; and the amine compound in the range of 0.1 to 100 parts by weight, preferably 0.1 to 50 parts by weight. It is noted that the amine compounds of this invention may be used alone or in combination with two or more.

To form the treating solution of this invention, these compounds may be dissolved in ion-exchange or tap water. While no critical limitation is placed on in what order they are dissolved in the water, it is preferred that the anionic compound capable of forming a chelate compound with zinc ions is dissloved in the water, followed by the addition of the amine compound. The treating solution may additionally contain pH regulators such as organic and inorganic salts or basic hydroxides, e.g., potassium and sodium hydroxides; wetting agents such as surface active agents, e.g., ethylene glycol, sorbitol, glycerin, gum arabic, dipropylene glycol, dimethylacetamide, hexylene glycol butadiol and butyl cellosolve; antiseptics such as salicylic acid, phenol butyl p-benzoate, sodium dehydroacetate and 4-isothiazolin-3-one compounds; rust preventives such as EDTA, pyrophosphoric acid, metaphosphoric acid, hexametaphosphoric acid and 2-mercaptobenzimidazole; and other additives, all in suitable amounts.

For using the treating solution practically, its pH may preferably be regulated to a value in the range of 3 to 6. This solution may be used as a dampening solution as well, if it is diluted with water.

As the amine compound of this invention is added to phytic acid and phytate, an amine salt of phytic acid is formed. It is presumed that since the amine compound has a higher aliphatic group—this is unlike lower amines and alkanolamine salts, that amine salt is so enhanced in the affinity for the non-image area of photosensitive material when immersed in the desensitizing solution that the ionization and chelation reactions of zinc oxide ions are promoted, resulting in an improvement in the etching rate.

Since the higher the etching rate, the shorter the etching time, the time for which the form plate is immersed in the etching solution can be made shorter than would be possible with the prior art, even at the same running number, thereby preventing incorporation of $Zn^{2+}$ ions ascribable to precipitates in the etching solution. In addition, since the amine compound of this invention is higher in the distillation point than lower amines and alkanolamines, there is less changes in the solution composition due to distillation, decomposition and other factors, even when the solution is used for an extended period of time or subject to an increase in the solution temperature. Thus, it is expected that the treating solution of this invention is improved in terms of the stability with time and the running properties.

As described above, the treating solution of this invention does not contain ferrocyanides and ferricyanides that pose a pollution problem and degrade by light and heat, and so is stable, or does not discolor or precipitate, even upon storage over an extended period. In addition, the cyanogen-free, excellent etching solution can provide offset printing plate precursors which is less affected by printing environment than conventional cyanogen-free treating solutions, achieves much more improved film-forming rates and is not subject to scumming and degradation of dot gradation.

The present invention will now be explained more specifically but not exclusively with reference to the examples and comparative examples.

EXAMPLE A1

| | |
|---|---|
| Water | 1000 parts by weight |
| Potassium phytate | 80 parts by weight |
| Diisopropyl-2-ethylhexylamine | 4 parts by weight |

Comparative Example A1

Here the amine compound was removed from the solution of Ex. A1.

Comparative Example A2

Here diethylamine was used for the amine compound of Ex. A1.

Comparative Example A2

Here monoethanolamine was used in place of the amine compound of Ex. A1.

In each of Ex. A1 and Comp. Ex. A1 and A2, the components were well dissolved in water to prepare a treating solution, which was then regulated to pH 4.3 with the addition of KOH.

These solutions were used for actual printing. The results are set out in Table 1.

TABLE 1

| What Was Estimated | Example A1 | Comp. Ex. A1 | Comp. Ex. A2 | Comp. Ex. A3 |
|---|---|---|---|---|
| Water Retention of Plate Precursor | | | | |
| Note: 1) I (25° C., 60% RH) | Good ○ | Scumming found X | Little scumming found ○ Δ | Little scumming found ○ Δ |
| II (35° C., 80% RH) | Good ○ | Scumming found X | Scumming found X | Scumming found X |
| Running Properties | | | | |
| Note: 2) I | Good ○ | Scumming found X | Scumming found X Pricipitation found | Scumming found X Precipitation found |
| II | Good ○ | Scumming found X | Scumming found X Pricipitation found | Scumming found X Precipitation found |
| Note: 3 Stability with Time | Good ○ | Scumming found X | Little discoloration and scumming likely to occur Δ | Scumming likely to occur Δ |

The water retention of a plate precursor, running properties and stability with time were estimated as follows.

Note 1) Water Retention of Plate Precursor

A photosensitive material (that was not formed into a printing plate or, in other words, a plate precursor) was passed once through an etching machine, using each of the desensitizing solutions prepared in Example A1 and Comparative Examples A1–A3.

Then, this precursor was used to make 50 prints with Hamada Star 800SX Model made by Hamada Star K. K., using as the dampening solution the treating solution of Ex. A1 which was diluted with water 50 times. Whether or not there was scumming on the 50th print was visually estimated.

Note 2) Running Properties

A photosensitive material ELP-Ix and a fully-automatic Processor ELP404V (Fuji Photo Film Co., Ltd.) were allowed to stand at normal temperature and humidity (25° C. and 65%) for one day. Thereafter, plate-making was carried out to form a duplicate image. The thus obtained 6000 duplicate masters were each passed once through an etching machine containing each of the treating solutions prepared in Example A1 and Comparative Examples A1–A3.

Thereafter, the 6000th master was estimated in terms of printing and scumming, as was case with the water retention of the plate precursor.

Note 3) Stability with Time

The desensitizing solutions of Example A1 and Comparative Examples A1–A3 were placed under thermo-conditions (50° C. and 80% RH) for two weeks. Thereafter, duplicate masters were formed, as was the case with the estimation of running properties, and then passed once through an etching machine containing each of the desensitizing solutions mentioned above. Thereafter, estimation was made in terms of printing and scumming, as was the case with the water retention of the plate precursor.

The water retention of the plate precursor treated with the densensitizing solution of this invention is improved over that treated with Comparative Examples A1–A3. Especially when the environmental conditions are changed to (35° C. and 80% RH), the water retentions of the plate precursors treated with Comp. Ex. A2 and A3 decrease considerably, but that treated with Example A1 does not. In other words, the treating solution of this invention is characterized by being unlikely to be affected by environmental conditions.

The running properties according to Comparative Examples A2 and A3 degrade due to precipitation in the treating solutions, but the treating solution of this invention gives rise to no precipitation and maintains its initial capacity, even after being run 6000 times. In addition, the treating solution of this invention is better than those of Comparative Examples A1–A3 in terms of stability with time, so that it can well stand up to long-term storage.

As mentioned above, only the desensitizing solution of this invention can stand up to environment conditions, continued use and long-term storage and, besides, gives rise to no scumming.

EXAMPLES A2–A25

For the amine compound used in Example A1, amine compounds shown in Table 2 were used in amounts shown in Table 2. Estimation was made following Example A1.

TABLE 2

| Example No. | Amine Compound No. | Amount (parts by weight) |
|---|---|---|
| A2 | 1 | 2 |
| A3 | 1 | 6 |
| A4 | 1 | 10 |
| A5 | 2 | 2 |
| A6 | 2 | 4 |
| A7 | 2 | 6 |
| A8 | 2 | 10 |
| A9 | 3 | 4 |
| A10 | 8 | 4 |
| A11 | 10 | 4 |
| A12 | 14 | 4 |
| A13 | 23 | 4 |
| A14 | 29 | 4 |
| A15 | 31 | 4 |
| A16 | 34 | 4 |
| A17 | 42 | 4 |
| A18 | 45 | 4 |
| A19 | 54 | 4 |
| A20 | 56 | 4 |
| A21 | 60 | 4 |
| A22 | 62 | 4 |
| A23 | 67 | 4 |
| A24 | 71 | 4 |
| A25 | 93 | 4 |

Like Example A1, Examples. A2–A25 were all excellent in terms of the water retentions of plate precursors, environmental changes, running properties and stability with time.

EXAMPLES A26–A41

Using some combinations of the amine compounds shown in Table 3 in a constant amount of 4 parts by weight, the water retention of plate precursors, running properties and stability with time were estimated by following the procedures of Example A1.

TABLE 3

| | Combinations of Amine Compounds | |
|---|---|---|
| Example No. | Compound Nos. | weight % |
| A26 | (1)/(2) | 50/50 |
| A27 | (1)/(2) | 25/75 |
| A28 | (1)/(2) | 75/25 |
| A29 | (1)/(24) | 50/50 |
| A30 | (1)/(2)/(3) | 25/25/50 |
| A31 | (1)/(29) | 50/50 |
| A32 | (1)/(34) | 50/50 |
| A33 | (29)/(34) | 50/50 |
| A34 | (1)/(34)/(64) | 50/25/25 |
| A35 | (2)/(34)/(52) | 50/25/25 |
| A36 | (2)/(71)/(83) | 50/25/25 |
| A37 | (54)/(89)/(93) | 50/25/25 |
| A38 | (34)/(52)/(79) | 50/25/25 |
| A39 | (34)/(47)/95) | 50/25/25 |
| A40 | (1)/(34)/(80)/(93) | 25/25/25/25 |
| A41 | (1)/(2)/(34)/(62) | 25/25/25/25 |

Like Example A1, Examples A26–A41 are all excellent in terms of the water retentions of plate precursors, environmental changes, running properties and stability with time, indicating that the amine compounds of this invention may be used in combination with no problem. Examples A42–A48

Following the procedures of Example A1, various properties were estimated of a treating solution obtained by adding various wetting agents, antiseptics and rust preventives to the desensitizing solution having the same composition as that of Example A1.

TABLE 4

| Ex. No. | Wetting Agent | Anticeptic | Rust Preventive |
|---|---|---|---|
| A42 | Ethylene glycol | Salicylic acid | EDTA |
| A43 | Ethylene glycol | Salicylic acid | Metaphosphoric acid |
| A44 | Ethylene glycol | Salicylic acid | 2-Mercaptobenz imidazole |
| A45 | Ethylene glycol | Sodium Dehydro-acetate | EDTA |
| A45 | Gum arabic | Salicylic acid | EDTA |
| A47 | Dimethylacet-amide | Salicylic acid | EDTA |
| A48 | Butyl Cello-solve | Salicylic acid | EDTA |

Like Example A1, Examples A42–A48 are all excellent in the water retention of plate precursors, environmental changes, running properties and stability with time, indicating that the performance of the desensitizing solution of this invention is not affected by the addition of various additives.

Example A49

The dampening solution used was obtained by diluting the treating solution of Ex. A1 five times with distilled water.

Comparative Example A4

The dampening solution used was obtained by diluting the treating solution of Comp. Ex. A1 five times with distilled water.

Comparative Example A5

The dampening solution used was obtained by diluting the treating solution of Comp. Ex. A2 five times with distilled water.

Set out in Table 5 are the results of estimation of Example A49 and Comparative Examples A4 and A5.

TABLE 5

| What Was Estimated | Example A49 | Comp. Ex. A4 | Comp. Ex. A5 |
|---|---|---|---|
| Note: 4) Scumming on prints | No scumming was found until 5000 prints | Scumming was found on the 1000th prints | Scumming was found on the 2000th prints |

Whether or not there was scumming on the prints was estimated as follows.

Note 4) Scumming on Prints

After plate-making had been carried out following the procedures of Note 2), each plate was passed once through an etching machine, using the desensitizing solution of Example A1. Using the plate together with Hamada Star 800SX Model (Hamada Star K. K.) and the dampening solutions of Example A49 and Comp. Ex. A4 and A5, printing was done to count the number of prints until scumming could be visually observed.

As compared with Comp. Ex. A4 and A5, the desensitizing solution of this invention gives rise to no scumming, indicating that it can be Used as a dampening solution with high performance.

EXAMPLE B1

| | |
|---|---|
| Water | 1000 parts by weight |
| Potassium phytate | 80 parts by weight |
| 2-N,N'-dimethylaminopropionic acid-2-ethylhexylester | 4 parts by weight |

Comparative Example B1

Here the amine compound was removed from the solution of Ex. B1.

Comparative Example B2

Here diethylamine was used in place of the amine compound of Ex. B1.

Comparative Example B3

Here monoethanolamine was used in place of the amine compound of Ex. B1.

In each of Ex. B1 and Comp. Ex. B1–B3, the components were well dissolved in water to prepare a treating solution, which was then regulated to pH 4.3 with the addition of KOH.

These solutions were used for actual printing. The results are set out in Table 6.

TABLE 6

| What Was Estimated | Example B1 | Comp. Ex. B1 | Comp. Ex. B2 | Comp. Ex. B3 |
|---|---|---|---|---|
| Water Retention of Plate Precursor | | | | |
| Note: 1) I (25° C., 60% RH) | Good ○ | Scumming found X | Little scumming found ○ Δ | Little scumming found ○ Δ |
| II (35° C., 80% RH) | Good ○ | Scumming found X | Scumming found X | Scumming found X |
| Running Properties | | | | |
| Note: 2) I | Good ○ | Scumming found X | Scumming found X Pricipitation found | Scumming found X Precipitation found |
| II | Good ○ | Scumming found X | Scumming found X Pricipitation found | Scumming found X Precipitation found |
| Note: 3 Stability with Time | Good ○ | Scumming found X | Little discoloration and scumming likely to occur Δ | Scumming likely to occur Δ |

The water retention of a plate precursor, running properties and stability with time referred to in Table 6 were estimated according to the procedures mentioned in connection with Table 1.

The water retention of the plate precursor treated with the desensitizing solution of this invention is improved over that treated with Comparative Examples B1–B3, Especially when the environmental conditions are changed to (35° C. and 80% RH), the water retentions of the plate precursors treated with Comp. Ex. B2 and B3 decrease considerably, but that treated with Example B1 does not. In other words, the treating solution of this invention is characterized by being unlikely to be affected by environmental conditions.

The running properties according to Comparative Examples B2 and B3 degrade due to precipitation in the treating solutions, but the treating solution of this invention gives rise to no precipitation and maintains its initial capacity, even after being run 6000 times. In addition, the treating solution of this invention is better than those of Comparative Examples B1–B3 in terms of stability with time, so that it can well stand up to long-term storage.

As mentioned above, only the desensitizing solution of this invention can stand up to environment conditions, continued use and long-term storage and, besides, gives rise to no scumming.

EXAMPLES B2–B25

In lieu of the amine compound used in Example B1, amine compounds shown in Table 7 were used in amounts shown in Table 7. Estimation was made following Example B1.

TABLE 7

| Example No. | Amine Compound No. | Amount (parts by weight) |
|---|---|---|
| B2 | 101 | 2 |
| B3 | 101 | 6 |
| B4 | 101 | 10 |
| B5 | 102 | 2 |
| B6 | 102 | 4 |
| B7 | 102 | 6 |

TABLE 7-continued

| Example No. | Amine Compound No. | Amount (parts by weight) |
|---|---|---|
| B8 | 102 | 10 |
| B9 | 106 | 4 |
| B10 | 108 | 4 |
| B11 | 109 | 4 |
| B12 | 122 | 4 |
| B13 | 130 | 4 |
| B14 | 141 | 4 |
| B15 | 153 | 4 |
| B16 | 169 | 4 |
| B17 | 179 | 4 |
| B18 | 193 | 4 |
| B19 | 196 | 4 |
| B20 | 197 | 4 |
| B21 | 206 | 4 |
| B22 | 221 | 4 |
| B23 | 230 | 4 |
| B24 | 237 | 4 |
| B25 | 247 | 4 |

Like Example B1, Examples B2–B25 were all excellent in terms of the water retention of plate precursors, environmental changes, running properties and. stability with time.

EXAMPLES B26–B41

Using some combinations of the amine compounds shown in Table 8 in a fixed amount of 4 parts by weight, the water retention of plate precursors, running properties and stability with time were estimated by following the procedures of Example B1.

TABLE 8

| | Combinations of Amine Compounds | |
|---|---|---|
| Example No. | Compound Nos. | weight % |
| B26 | 101/102 | 50/50 |
| B27 | 101/102 | 25/75 |
| B28 | 101/102 | 75/25 |
| B29 | 101/196 | 50/50 |
| B30 | 101/102/103 | 25/25/50 |
| B31 | 101/169 | 50/50 |
| B32 | 101/142 | 50/50 |
| B33 | 142/196 | 50/50 |
| B34 | 101/142/96 | 50/25/25 |
| B35 | 102/159/196 | 50/25/25 |
| B36 | 102/190/196 | 50/25/25 |
| B37 | 154/197/121 | 50/25/25 |
| B38 | 196/197/198 | 50/25/25 |
| B39 | 196/121/136 | 50/25/25 |
| B40 | 101/196/125/136 | 25/25/25/25 |
| B41 | 101/102/196/197 | 25/25/25/25 |

Like Example B1, Examples B26–B41 are all excellent in terms of the water retention of plate precursors, environmental changes, running properties and stability with time, indicating that the amine compounds of this invention may be used in combination with no problem.

EXAMPLES B42–B48

Following the procedures of Example B1, various properties were estimated of a treating solution obtained by adding various wetting agents, antiseptics and rust preventives to the desensitizing solution having the same composition as that of Example B1.

TABLE 9

| Ex. No. | Wetting Agent | Anticeptic | Rust Preventive |
|---|---|---|---|
| B42 | Ethylene glycol | Salicylic acid | EDTA |
| B43 | Ethylene glycol | Salicylic acid | Metaphosphoric acid |
| B44 | Ethylene glycol | Salicylic acid | 2-Mercaptobenz imidazole |
| B45 | Ethylene glycol | Sodium Dehydro-acetate | EDTA |
| B45 | Gum arabic | Salicylic acid | EDTA |
| B47 | Dimethylacet-amide | Salicylic acid | EDTA |
| B48 | Butyl Cello-solve | Salicylic acid | EDTA |

Like Example B1, Examples B42–B48 are all excellent in the water retentions of plate precursors, environmental changes, running properties and stability with time, indicating that the performance of the desensitizing solution of this invention is not affected by the addition of various additives.

Example B49

The dampening solution used was obtained by diluting the treating solution of Ex. B1 five times with distilled water.

Comparative Example B4

The dampening solution used was obtained by diluting the treating solution of Comp. Ex. B1 five times with distilled water.

Comparative Example B5

The dampening solution used was obtained by diluting the treating solution of Comp. Ex. B2 five times with distilled water.

Set out in Table 10 are the results of estimation of Example B49 and Comparative Examples B4 and B5.

TABLE 10

| What Was Estimated | Example B49 | Comp. Ex. B4 | Comp. Ex. B5 |
|---|---|---|---|
| Note: 4) Scumming on prints | No scumming was found until 5000 prints | Scumming was found on the 1000th prints | Scumming was found on the 2000th prints |

Whether or not there was scumming on the prints was estimated as follows.

As compared with Comp. Ex. B4 and B5, the desensitizing solution of this invention gives rise to no scumming, indicating that it can be used as a dampening solution with high performance.

EXAMPLE C1

| | |
|---|---|
| Water | 1000 parts by weight |
| Potassium phytate | 80 parts by weight |
| N'-dimethylaminopropyl-N-hexylurea | 4 parts by weight |

Comparative Example C1

Here the amine compound was removed from the solution of Ex. C1.

Comparative Example C2

Here diethylamine was used in place of the amine compound of Ex. C1.

Comparative Example C3

Here monoethanolamine was used in place of the amine compound of Ex. C1.

In each of Ex. C1 and Comp. Ex. C1–C3, the components were well dissolved in water to prepare a treating solution, which was then regulated to pH 4.3 with the addition of KOH.

These solutions were used for actual printing. The results are set out in Table 11.

TABLE 11

| What Was Estimated | Example C1 | Comp. Ex. C1 | Comp. Ex. C2 | Comp. Ex. C3 |
|---|---|---|---|---|
| Water Retention of Plate Precursor | | | | |
| Note: 1) A (25° C., 60% RH) | Good ○ | Scumming found X | Little scumming found ○ Δ | Little scumming found ○ Δ |
| B (35° C., 80% RH) | Good ○ | Scumming found X | Scumming found X | Scumming found X |
| Running Properties | | | | |
| Note: 2) A | Good ○ | Scumming found X | Scumming found X Pricipitation found | Scumming found X Precipitation found |
| B | Good ○ | Scumming found X | Scumming found X Pricipitation found | Scumming found X Precipitation found |
| Note: 3 Stability with Time | Good ○ | Scumming found X | Little discoloration and scumming likely to occur Δ | Scumming likely to occur Δ |

The water retention of a plate precursor, running properties and stability with time referred to in Table 6 were estimated according to the procedures mentioned in connection with Table 11.

The water retention of the plate precursor treated with the desensitizing solution of this invention is improved over that treated with Comparative Examples C2–C3. Especially when the environmental conditions are changed to (35° C. and 80% RH), the water retentions of the plate precursors treated with Comp. Ex. C2 and C3 decrease considerably, but that treated with Example C1 does not. In other words, the treating solution of this invention is characterized by being unlikely to be affected by environmental conditions.

The running properties according to Comparative Examples C2 and C3 degrade due to precipitation in the treating solutions, but the treating solution of this invention gives rise to no precipitation and maintains its initial capacity, even after being run 6000 times. In addition, the treating solution of this invention is better than those of Comparative Examples C1–C3 in terms of stability with time, so that it can well stand up to long-term storage.

As mentioned above, only the desensitizing solution of this invention can stand up to environment conditions, continued use and long-term storage and, besides, gives rise to no scumming.

EXAMPLES C2–C25

In lieu of the amine compound Used in Example C1, amine compounds shown in Table 12 were used in amounts shown in Table 12. Estimation was made following Example C1.

TABLE 12

| Example No. | Amine Compound No. | Amount (parts by weight) |
|---|---|---|
| C2 | 301 | 2 |
| C3 | 301 | 6 |
| C4 | 301 | 10 |
| C5 | 374 | 2 |
| C6 | 374 | 4 |
| C7 | 374 | 6 |
| C8 | 374 | 10 |
| C9 | 304 | 4 |
| C10 | 347 | 4 |
| C11 | 352 | 4 |
| C12 | 367 | 4 |
| C13 | 430 | 4 |
| C14 | 442 | 4 |
| C15 | 371 | 4 |
| C16 | 410 | 4 |
| C17 | 415 | 4 |
| C18 | 425 | 4 |
| C19 | 456 | 4 |
| C20 | 463 | 4 |
| C21 | 349 | 4 |
| C22 | 413 | 4 |
| C23 | 317 | 4 |
| C24 | 334 | 4 |
| C25 | 383 | 4 |

Like Example C1, Examples C2–C25 were all excellent in terms of the water retention of plate precursors, environmental changes, running properties and stability with time.

EXAMPLES C26–C41

Using some combinations of the amine compounds shown in Table 13 in a fixed amount of 4 parts by weight, the water retention of plate precursors, running properties and stability with time were estimated by following the procedures of Example C1.

TABLE 13

| | Combinations of Amine Compounds | |
|---|---|---|
| Example No. | Compound Nos. | weight % |
| C26 | 301/374 | 50/50 |
| C27 | 301/374 | 25/75 |
| C28 | 301/374 | 75/25 |
| C29 | 301/304 | 50/50 |
| C30 | 301/374/304 | 25/25/50 |
| C31 | 301/352 | 50/50 |
| C32 | 301/363 | 50/50 |
| C33 | 374/415 | 50/50 |
| C34 | 301/374/430 | 50/25/25 |
| C35 | 304/374/142 | 50/25/25 |
| C36 | 304/371/383 | 50/25/25 |
| C37 | 354/389/393 | 50/25/25 |
| C38 | 334/352/379 | 50/25/25 |
| C39 | 334/347/395 | 50/25/25 |
| C40 | 301/334/380/393 | 25/25/25/25 |
| C41 | 301/302/334/362 | 25/25/25/25 |

Like Example C1, Examples C26–C41 are all excellent in terms of the water retention of plate precursors, environmental changes, running properties and stability with time, indicating that the amine compounds of this invention may be used in combination with no problem.

EXAMPLES C42–C48

Following the procedures of Example C1, various properties were estimated of a treating solution obtained by adding various wetting agents, antiseptics and rust preventives to the desensitizing solution having the same composition as that of Example C1.

TABLE 14

| Ex. No. | Wetting Agent | Anticeptic | Rust Preventive |
|---|---|---|---|
| C42 | Ethylene glycol | Salicylic acid | EDTA |
| C43 | Ethylene glycol | Salicylic acid | Metaphosphoric acid |
| C44 | Ethylene glycol | Salicylic acid | 2-Mercaptobenz imidazole |
| C45 | Ethylene glycol | Sodium Dehydro-acetate | EDTA |
| C45 | Gum arabic | Salicylic acid | EDTA |
| C47 | Dimethylacet-amide | Salicylic acid | EDTA |
| C48 | Butyl Cello-solve | Salicylic acid | EDTA |

Like Example C1, Examples C42–C48 are all excellent in the water retentions of plate precursors, environmental changes, running properties and stability with time, indicating that the performance of the desensitizing solution of this invention is not affected by the addition of various additives.

Example C49

The dampening solution used was obtained by diluting the treating solution of Ex. C1 five times with distilled water.

Comparative Example C4

The dampening solution used was obtained by diluting the treating solution of Comp. Ex. C1 five times with distilled water.

Comparative Example C5

The dampening solution used was obtained by diluting the treating solution of Comp. Ex. C2 five times with distilled water.

Set out in Table 15 are the results of estimation of Example 049 and Comparative Examples C4 and C5.

TABLE 15

| What Was Estimated | Example C49 | Comp. Ex. C4 | Comp. Ex. C5 |
|---|---|---|---|
| Note: 4) Scumming on prints | No scumming was found until 5000 prints | Scumming was found on the 1000th prints | Scumming was found on the 2000th prints |

Whether or not there was scumming on the prints was estimated as follows.

As compared with Comp. Ex. C4 and C5, the desensitizing solution of this invention gives rise to no scumming, indicating that it can be used as a dampening solution with high performance.

EXAMPLE D1

| | |
|---|---|
| Water | 1000 parts by weight |
| Potassium phytate | 80 parts by weight |
| N-[N,N'-diethylaminopropyl n-dodecylamide | 4 parts by weight |

Comparative Example D1

Here the amine compound was removed from the solution of Ex. D1.

Comparative Example D2

Here diethylamine was used in place of the amine compound of Ex. D1.

Comparative Example D3

Here monoethanolamine was used in place of the amine compound of Ex. D1.

In each of Ex. D1 and Comp. Ex. D1–D3, the components were well dissolved in water to prepare a treating solution, which was then regulated to pH 4.3 with the addition of KOH.

These solutions were used for actual printing. The results are set out in Table 16.

TABLE 16

| What Was Estimated | Example D1 | Comp. Ex. D1 | Comp. Ex. D2 | Comp. Ex. D3 |
|---|---|---|---|---|
| Water Retention of Plate Precursor | | | | |
| Note: 1) (25° C., 60% RH) | Good ○ | Scumming found X | Little scumming found ○ Δ | Little scumming found ○ Δ |
| (35° C., 80% RH) | Good ○ | Scumming found X | Scumming found X | Scumming found X |
| Running Properties | | | | |
| Note: 2) (25° C., 60% RH) | Good ○ | Scumming found X | Scumming found X Pricipitation found | Scumming found X Precipitation found |
| (35° C., 80% RH) | Good ○ | Scumming found X | Scumming found X Pricipitation found | Scumming found X Precipitation found |
| Note: 3 Stability with Time | Good ○ | Scumming found X | Little discoloration and scumming likely to occur Δ | Scumming likely to occur Δ |

The water retention of a plate precursor, running properties and stability with time referred to in Table 16 were estimated according to the procedures mentioned in connection with Table 1.

The water retention of the plate precursor treated with the desensitizing solution of this invention is improved over that treated with Comparative Examples D1–D3. Especially when the environmental conditions are changed to (35° C. and 80% RH), the water retentions of the plate precursors treated with Comp. Ex. D2 and D3 decrease considerably, but that treated with Example D1 does not. In other words, the treating solution of this invention is characterized by being unlikely to be affected by environmental conditions.

The running properties according to Comparative Examples D2 and D3 degrade due to precipitation in the treating solutions, but the treating solution of this invention gives rise to no precipitation and maintains its initial capacity, even after being run 6000 times. In addition, the treating solution of this invention is better than those of Comparative Examples D1–D3 in terms of stability with time, so that it can well stand up to long-term storage.

As mentioned above, only the desensitizing solution of this invention can stand up to environment conditions, continued use and long-term storage and, besides, gives rise to no scumming.

EXAMPLES D2–D25

In lieu of the amine compound used in Example D1, amine compounds shown in Table 17 were used in amounts shown in Table 17. Estimation was made following Example D1.

TABLE 17

| Example No. | Amine Compound No. | Amount (parts by weight) |
|---|---|---|
| D2 | 501 | 2 |
| D3 | 501 | 6 |
| D4 | 501 | 10 |
| D5 | 502 | 2 |
| D6 | 502 | 4 |
| D7 | 502 | 6 |
| D8 | 502 | 10 |
| D9 | 503 | 4 |
| D10 | 520 | 4 |
| D11 | 536 | 4 |
| D12 | 551 | 4 |
| D13 | 564 | 4 |
| D14 | 575 | 4 |
| D15 | 575 | 4 |
| D16 | 575 | 4 |
| D17 | 576 | 4 |
| D18 | 576 | 4 |
| D19 | 576 | 4 |
| D20 | 586 | 4 |
| D21 | 592 | 4 |
| D22 | 600 | 4 |
| D23 | 622 | 4 |
| D24 | 629 | 4 |
| D25 | 631 | 4 |

Like Example D1, Examples D2–D25 were all excellent in terms of the water retention of plate precursors, environmental changes, running properties and stability with time.

EXAMPLES D26–D41

Using some combinations of the amine compounds shown in Table 8 in a fixed amount of 4 parts by weight, the water retention of plate precursors, running properties and stability with time were estimated by following the procedures of Example D1.

TABLE 18

| | Combinations of Amine Compounds | |
|---|---|---|
| Example No. | Compound Nos. | weight % |
| D26 | 501/502 | 50/50 |
| D27 | 501/502 | 25/75 |
| D28 | 501/502 | 75/25 |
| D29 | 501/575 | 50/50 |
| D30 | 501/575/504 | 25/25/50 |
| D31 | 501/520 | 50/50 |
| D32 | 101/142 | 50/50 |
| D33 | 575/576 | 50/50 |
| D34 | 501/575/631 | 50/25/25 |
| D35 | 504/576/629 | 50/25/25 |
| D36 | 504/551/575 | 50/25/25 |
| D37 | 575/586/592 | 50/25/25 |
| D38 | 576/591/131 | 50/25/25 |
| D39 | 576/600/623 | 50/25/25 |
| D40 | 501/551/576/622 | 25/25/25/25 |
| D41 | 501/502/534/562 | 25/25/25/25 |

Like Example D1, Examples D26–D41 are all excellent in terms of the water retention of plate precursors, environmental changes, running properties and stability with time, indicating that the amine compounds of this invention may be used in combination with no problem.

EXAMPLES D42–D48

Following the procedures of Example D1, various properties were estimated of a treating solution obtained by adding various wetting agents, antiseptics and rust preventives to the desensitizing solution having the same composition as that of Example D1.

TABLE 19

| Ex. No. | Wetting Agent | Anticeptic | Rust Preventive |
|---|---|---|---|
| D42 | Ethylene glycol | Salicylic acid | EDTA |
| D43 | Ethylene glycol | Salicylic acid | Metaphosphoric acid |
| D44 | Ethylene glycol | Salicylic acid | 2-Mercaptobenz imidazole |
| D45 | Ethylene glycol | Sodium Dehydro-acetate | EDTA |
| D45 | Gum arabic | Salicylic acid | EDTA |
| D47 | Dimethylacet-amide | Salicylic acid | EDTA |
| D48 | Butyl Cello-solve | Salicylic acid | EDTA |

Like Example D1, Examples D42–D48 are all excellent in the water retentions of plate precursors, environmental changes, running properties and stability with time, indicating that the performance of the desensitizing solution of this invention is not affected by the addition of various additives.

EXAMPLE D49

The dampening solution used was obtained by diluting the treating solution of Ex. D1 five times with distilled water.

Comparative Example D4

The dampening solution used was obtained by diluting the treating solution of Comp. Ex. D1 five times with distilled water.

Comparative Example D5

The dampening solution used was obtained by diluting the treating solution of Comp. Ex. D2 five times with distilled water.

Set out in Table 20 are the results of estimation of Example D49 and Comparative Examples D4 and D5.

TABLE 20

| What Was Estimated | Example D49 | Comp. Ex. D4 | Comp. Ex. D5 |
|---|---|---|---|
| Note: 4) Scumming on prints | No scumming was found until 5000 prints | Scumming was found on the 1000th prints | Scumming was found on the 2000th prints |

Whether or not there was scumming on the prints was estimated as follows.

As compared with Comp. Ex. D4 and D5, the desensitizing solution of this invention gives rise to no scumming, indicating that it can be used as a dampening solution with high performance.

EXAMPLE E1

| | |
|---|---|
| Water | 1000 parts by weight |
| Potassium phytate | 80 parts by weight |
| N-2-ethylhexylimidazole | 4 parts by weight |

Comparative Example E1

Here the amine compound was removed from the solution of Ex. E1.

Comparative Example E2

Here diethylamine was used in place of the amine compound of Ex. E1.

Comparative Example E3

Here monoethanolamine was used in place of the amine compound of Ex. E1.

In each of Ex. E1 and Comp. Ex. E1–E3, the components were well dissolved in water to prepare a treating solution, which was then regulated to pH 4.3 with the addition of KOH.

These solutions were used for actual printing. The results are set out in Table 21.

TABLE 21

| What Was Estimated | Example E1 | Comp. Ex. E1 | Comp. Ex. E2 | Comp. Ex. E3 |
|---|---|---|---|---|
| Water Retention of Plate Precursor | | | | |
| Note: 1) (25° C., 60% RH) | Good ○ | Scumming found X | Little scumming found ○ Δ | Little scumming found ○ Δ |
| (35° C., 80% RH) | Good ○ | Scumming found X | Scumming found X | Scumming found X |
| Running Properties | | | | |
| Note: 2) (25° C., 60% RH) | Good ○ | Scumming found X | Scumming found X Pricipitation found | Scumming found X Precipitation found |
| (35° C., 80% RH) | Good ○ | Scumming found X | Scumming found X Pricipitation found | Scumming found X Precipitation found |
| Note: 3 Stability with Time | Good ○ | Scumming found X | Little discoloration and scumming likely to occur Δ | Scumming likely to occur Δ |

The water retention of a plate precursor, running properties and stability with time referred to in Table 21 were estimated according to the procedures mentioned in connection with Table 1.

The water retention of the plate precursor treated with the desensitizing solution of this invention is improved over that treated with Comparative Examples E1–E3. Especially when the environmental conditions are changed to (35° C. and 80% RH), the water retentions of the plate precursors treated with Comp. Ex. E2 and E3 decrease considerably, but that treated with Example E1 does not. In other words, the treating solution of this invention is characterized by being unlikely to be affected by environmental conditions.

The running properties according to Comparative Examples E2 and E3 degrade due to precipitation in the treating solutions, but the treating solution of this invention gives rise to no precipitation and maintains its initial capacity, even after being run 6000 times. In addition, the treating solution of this invention is better than those of Comparative Examples E1–E3 in terms of stability with time, so that it can well stand up to long-term storage.

As mentioned above, only the desensitizing solution of this invention can stand up to environment conditions, continued use and long-term storage and, besides, gives rise to no scumming.

EXAMPLES E2–E25

In lieu of the amine compound used in Example E1, amine compounds shown in Table 22 were used in amounts shown in Table 22. Estimation was made following Example E1.

TABLE 22

| Example No. | Amine Compound No. | Amount (parts by weight) |
|---|---|---|
| E2 | 701 | 2 |
| E3 | 701 | 6 |
| E4 | 701 | 10 |
| E5 | 723 | 2 |
| E6 | 723 | 4 |
| E7 | 723 | 6 |
| E8 | 723 | 10 |
| E9 | 705 | 4 |
| E10 | 715 | 4 |
| E11 | 725 | 4 |
| E12 | 732 | 4 |
| E13 | 736 | 4 |
| E14 | 44 | 4 |
| E15 | 750 | 4 |
| E16 | 755 | 4 |
| E17 | 760 | 4 |
| E18 | 764 | 4 |
| E19 | 767 | 4 |
| E20 | 768 | 4 |
| E21 | 783 | 4 |
| E22 | 773 | 4 |
| E23 | 777 | 4 |
| E24 | 798 | 4 |
| E25 | 800 | 4 |

Like Example E1, Examples E2–E25 were all excellent in terms of the water retention of plate precursors, environmental changes, running properties and stability with time.

EXAMPLES E26–E41

Using some combinations of the amine compounds shown in Table 23 in a fixed amount of 4 parts by weight, the water retention of plate precursors, running properties and stability with time were estimated by following the procedures of Example E1.

TABLE 23

| | Combinations of Amine Compounds | |
|---|---|---|
| Example No. | Compound Nos. | weight % |
| E26 | 701/723 | 50/50 |
| E27 | 701/723 | 25/75 |
| E28 | 701/723 | 75/25 |
| E29 | 701/705 | 50/50 |

TABLE 23-continued

| Example No. | Combinations of Amine Compounds Compound Nos. | weight % |
|---|---|---|
| E30 | 701/702/705 | 25/25/50 |
| E31 | 701/732 | 50/50 |
| E32 | 701/736 | 50/50 |
| E33 | 701/744 | 50/50 |
| E34 | 701/723/744 | 50/25/25 |
| E35 | 702/734/752 | 50/25/25 |
| E36 | 702/771/738 | 50/25/25 |
| E37 | 754/789/793 | 50/25/25 |
| E38 | 734/752/779 | 50/25/25 |
| E39 | 734/747/795 | 50/25/25 |
| E40 | 701/702/780/793 | 25/25/25/25 |
| E41 | 701/702/734/762 | 25/25/25/25 |

Like Example E1, Examples E26–E41 are all excellent in terms of the water retention of plate precursors, environmental changes, running properties and stability with time, indicating that the amine compounds of this invention may be used in combination with no problem.

EXAMPLES E42–E48

Following the procedures of Example E1, various properties were estimated of a treating solution obtained by adding various wetting agents, antiseptics and rust preventives shown Table 24 to the desensitizing solution having the same composition as that of Example E1.

TABLE 24

| Ex. No. | Wetting Agent | Anticeptic | Rust Preventive |
|---|---|---|---|
| E42 | Ethylene glycol | Salicylic acid | EDTA |
| E43 | Ethylene glycol | Salicylic acid | Metaphosphoric acid |
| E44 | Ethylene glycol | Salicylic acid | 2-Mercaptobenz imidazole |
| E45 | Ethylene glycol | Sodium Dehydro-acetate | EDTA |
| E45 | Gum arabic | Salicylic acid | EDTA |
| E47 | Dimethylacet-amide | Salicylic acid | EDTA |
| E48 | Butyl Cello-solve | Salicylic acid | EDTA |

Like Example E1, Examples E42–E48 are all excellent in the water retentions of plate precursors, environmental changes, running properties and stability with time, indicating that the performance of the desensitizing solution of this invention is not affected by the addition of various additives.

EXAMPLE E49

The dampening solution used was obtained by diluting the treating solution of Ex. E1 five times with distilled water.

Comparative Example E4

The dampening solution used was obtained by diluting the treating solution of Comp. Ex. E1 five times with distilled water.

Comparative Example E5

The dampening solution used was obtained by diluting the treating solution of Comp. Ex. E2 five times with distilled water.

Set out in Table 25 are the results of estimation of Example E49 and Comparative Examples E4 and E5.

TABLE 25

| What Was Estimated | Example E49 | Comp. Ex. E4 | Comp. Ex. E5 |
|---|---|---|---|
| Note: 4) Scumming on prints | No scumming was found until 5000 prints | Scumming was found on the 1000th prints | Scumming was found on the 2000th prints |

Whether or not there was scumming on the prints was estimated as follows.

As compared with Comp. Ex. E4 and E5, the desensitizing solution of this invention gives rise to no scumming, indicating that it can be used as a dampening solution with high performance.

According to this invention, there can be provided a desensitizing or dampening solution for offset printing plate precursors, which pose no pollution problem, can be stable to long-term storage, continued use and environmental changes and can reduce the etching time or is excellent in the desensitizing capability.

What we claim:

1. A method for electrophotographic offset printing wherein an electrophotographic offset printing plate having a photoconductive layer thereon is exposed to form an image and the exposed photoconductive layer is treated with a desensitizing solution to render non-image areas thereon hydrophilic to prevent adhesion of printing ink to said non-image areas, the improvement which comprises the desensitizing solution comprising an amine compound-containing, cyanogen-free, desensitizing solution for electrophotographic offset printing comprising:

at least one compound selected from the group consisting of phytic acid, metal salts of phytic acid and ammonium salts of phytic acids; and at least one compound selected from the group consisting of secondary and tertiary amines having the formula (1):

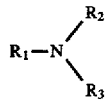

(1)

wherein $R_1$ is an aliphatic group having 8 to 18 carbon atoms and $R_2$ and $R_3$ each is hydrogen or an aliphatic group having 1 to 18 carbon atoms.

2. A method for electrophotographic offset priming wherein an electrophotographic offset printing plate having a photoconductive layer thereon is exposed to form an image and the exposed photoconductive layer is treated with a desensitizing solution to render non-image areas thereon hydrophilic so as to prevent adhesion of printing ink to said non-image areas, the improvement which comprises the desensitizing solution comprising an amine compound-containing, cyanogen-free solution containing at least one compound selected from the group consisting of phytic acid, metal salts of phytic acid and ammonium salts of phytic acids; and at least one compound selected from the group consisting of secondary and tertiary amines having the formula (1):

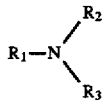

(1)

wherein $R_1$, $R_2$, and $R_3$ have at least 9 carbon atoms in all, and $R_1$ is an aliphatic group having at least 6 carbon atoms and $R_2$ and $R_3$ each is hydrogen, an aliphatic group, or, taken together, form a cyclic structure.

3. A method for electrophotographic offset priming wherein an electrophotographic offset printing plate having a photoconductive layer thereon is exposed to form an image and the exposed photoconductive layer is treated with a desensitizing solution to render non-image areas thereon hydrophilic so as to prevent adhesion of printing ink to said non-image areas, the improvement which comprises the desensitizing solution comprising an amine compound-containing, cyanogen-free, desensitizing solution for electrophotographic offset printing comprising:

at least one compound selected from the group consisting of phytic acid, metal salts of phytic acid, and ammonium salts of phytic acid, and at least one compound selected from the group consisting of urea compounds of formula (5) and urethane compounds of formula (6), each of which contains an amino group of formula (4) and each having an inorganic/organic value in the range of 0.1 to 4.0

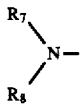

(4)

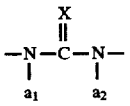

(5)

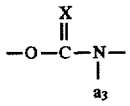

(6)

wherein $a_1$, $a_2$ and $a_3$ each may be hydrogen or an organic residue, $R_7$ and $R_8$ each may be hydrogen, an organic residue, or, taken together, form a cyclic structure, and X is oxygen or sulfur.

4. A method for electrophotographic offset printing wherein an electrophotographic offset printing plate having a photoconductive layer thereon is exposed to form an image and the exposed photoconductive layer is treated with a desensitizing solution to render non-image areas thereon hydrophilic so as to prevent adhesion of printing ink to said non-image areas, the improvement which comprises the desensitizing solution comprising an amine compound-containing, cyanogen-free, desensitizing solution for electrophotographic offset printing comprising:

at least one compound selected from the group consisting of phytic acid, metal salts of phytic acid, and ammonium salts of phytic acid, and at least one compound selected from the group consisting of an amide of formula (8) which contains an amino group of formula (7):

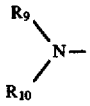

(7)

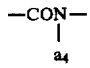

(8)

wherein $R_9$ is a non-substituted alkyl or a substituted alkyl, $R_{10}$ is a hydrogen atom or an organic residue, or, taken together, form a cyclic structure and $a_4$ denotes hydrogen atom, an organic residue, or a substituent selected from the group consisting of halogen atom, a cyano and nitro group.

5. A method for electrophotographic offset printing wherein an electrophotographic offset printing plate having a photoconductive layer thereon is exposed to form an image and the exposed photoconductive layer is treated with a desensitizing solution to render non-image areas thereon hydrophilic so as to prevent adhesion of printing ink to said non-image areas, the improvement which comprises the desensitizing solution comprising an amine compound-containing, cyanogen-free, desensitizing solution for electrophotographic offset printing comprising:

at least one compound selected from the group consisting of phytic acid, metal salts of phytic acid, and ammonium salts of phytic acid, and at least one compound selected from the group consisting of hetero-cyclic compounds containing at least one nitrogen atom and having an inorganic/organic value in the range from 1.0 to 4.0.

* * * * *